US006226608B1

(12) United States Patent
Fielder et al.

(10) Patent No.: US 6,226,608 B1
(45) Date of Patent: May 1, 2001

(54) DATA FRAMING FOR ADAPTIVE-BLOCK-LENGTH CODING SYSTEM

(75) Inventors: Louis Dunn Fielder, Millbrae; Michael Mead Truman, San Francisco, both of CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 09/239,345

(22) Filed: Jan. 28, 1999

(51) Int. Cl.[7] ..... G10L 19/00; G10L 21/04; G04N 9/475

(52) U.S. Cl. ..... 704/229; 704/500; 704/503; 704/211; 704/201; 704/200.1; 386/68; 345/515

(58) Field of Search ..... 704/229, 500, 704/211, 200.1, 201, 503, 502, 504; 386/68, 81; 348/515; 375/240.28

(56) References Cited

U.S. PATENT DOCUMENTS

| | | | | |
|---|---|---|---|---|
| 5,214,742 | | 5/1993 | Edler . | |
| 5,222,189 | | 6/1993 | Fielder . | |
| 5,394,473 | | 2/1995 | Davidson . | |
| 5,479,562 | * | 12/1995 | Fielder et al. | 704/229 |
| 5,640,486 | * | 6/1997 | Lim | 704/229 |
| 5,903,872 | * | 5/1999 | Fielder | 704/500 |
| 5,913,190 | | 6/1999 | Fielder et al. . | |
| 6,124,895 | * | 9/2000 | Fielder | 348/515 |
| 6,141,486 | * | 10/2000 | Lane et al. | 368/68 |

FOREIGN PATENT DOCUMENTS

| | | |
|---|---|---|
| WO 9745965 | 12/1997 | (WO) . |
| WO 9921189 | 4/1999 | (WO) . |

OTHER PUBLICATIONS

Smart, et al.; "Filter Bank Design Based on Time Domain Aliasing Cancellation with Non–Identical Windows," Proceedings of the International Conference on Acoustics, Speech, and Signal Processing (ICASSP), US, New York, IEEE, 1994, pp. III–185–III–188.

"Analysis/Synthesis Filter Bank Design Based on Time Domain Aliasing Cancellation," by John P. Princen et al., IEEE Transactions on Acoustics, Speech, and Signal Processing, vol. ASSP–34, No. 5, Oct. 86, 1153–61.

"Subband/Transform Coding Using Filter Bank Designs Based on Time Domain Aliasing Cancellation," by J.P. Princen, et al., ICASSP 1987, Dallas, vol. 4, pp. 2161–2164.

"Codierung uon Audiosignalen mit überlappender Transformation and adaptiven Fensterfunktionen," by B. Edler, Frequenz, 43 (1989) 9 (Translation included).

"AC–2 and AC–3: Low–Complexity Transform–Based Audio Coding," by Fielder, et al., AES 1996, pp. 54–72.

"ISO/IEC MPEG–2 Advanced Audio Coding," by M. Bosi, et al., J. AES, Oct. 1997, pp. 789–814.

* cited by examiner

*Primary Examiner*—William R. Korzuch
*Assistant Examiner*—Vijay B Chawan
(74) *Attorney, Agent, or Firm*—Gallagher & Lathrop; David N. Lathrop

(57) ABSTRACT

An audio encoder applies an adaptive block-encoding process to segments of audio information to generate frames of encoded information that are aligned with a reference signal conveying the alignment of a sequence of video information frames. The audio information is analyzed to determine various characteristics of the audio signal such as the occurrence and location of a transient, and a control signal is generated that causes the adaptive block-encoding process to encode segments of varying length. A complementary decoder applies an adaptive block-decoding process to recover the segments of audio information from the frames of encoded information. In embodiments that apply time-domain aliasing cancellation (TDAC) transforms, window functions and transforms are applied according to one of a plurality of segment patterns that define window functions and transform parameters for each segment in a sequence of segments. The segments in each frame of a sequence of overlapping frames may be recovered without aliasing artifacts independently from the recovery of segments in other frames. Window functions are adapted to provide preferred frequency-domain responses and time-domain gain profiles.

32 Claims, 8 Drawing Sheets

DATA FRAMING FOR ADAPTIVE-BLOCK-LENGTH CODING SYSTEM

CROSS-REFERENCE TO RELATED APPLICATIONS

This application is related to U.S. patent application entitled "Frame-Based Audio Coding With Additional Filterbank to Suppress Aliasing Artifacts at Frame Boundaries," Ser. No. 08/953,121 filed Oct. 17, 1997, U.S. patent application entitled "Frame-Based Audio Coding With Additional Filterbank to Attenuate Spectral Splatter at Frame Boundaries," Ser. No. 08/953,106 filed Oct. 17, 1997, U.S. patent application entitled "Frame-Based Audio Coding With Video/Audio Data Synchronization by Audio Sample Rate Conversion," Ser. No. 08/953,306 filed Oct. 17, 1997, and U.S. patent application entitled "Using Time-Aligned Blocks of Encoded Audio in Video/Audio Applications to Facilitate Audio Switching," Ser. No. 09/042,367 filed Mar. 13, 1998, all of which are incorporated herein by reference.

TECHNICAL FIELD

The present invention is related to audio signal processing in which audio information streams are encoded and assembled into frames of encoded information. In particular, the present invention is related to improving the quality of audio information streams conveyed by and recovered from the frames of encoded information.

BACKGROUND ART

In many video/audio systems, video/audio information is conveyed in information streams comprising frames of encoded audio information that are aligned with frames of video information, which means the sound content of the audio information that is encoded into a given audio frame is related to the picture content of a video frame that is either substantially coincident with the given audio frame or that leads or lags the given audio frame by some specified amount. Typically, the audio information is conveyed in an encoded form that has reduced information capacity requirements so that some desired number of channels of audio information, say between three and eight channels, can be conveyed in the available bandwidth.

These video/audio information streams are frequently subjected to a variety of editing and signal processing operations. A common editing operation cuts one or more streams of video/audio information into sections and joins or splices the ends of two sections to form a new information stream. Typically, the cuts are made at points that are aligned with the video information so that video synchronization is maintained in the new information stream. A simple editing paradigm is the process of cutting and splicing motion picture film. The two sections of material to be spliced may originate from different sources, e.g., different channels of information, or they may originate from the same source. In either case, the splice generally creates a discontinuity in the audio information that may or may not be perceptible.

A. Audio Coding

The growing use of digital audio has tended to make it more difficult to edit audio information without creating audible artifacts in the processed information. This difficulty has arisen in part because digital audio is frequently processed or encoded in segments or blocks of digital samples that must be processed as a complete entity. Many perceptual or psychoacoustic-based audio coding systems utilize filterbanks or transforms to convert segments of signal samples into blocks of encoded subband signal samples or transform coefficients that must be synthesis filtered or inverse transformed as complete blocks to recover a replica of the original signal segment. Editing operations are more difficult because an edit of the processed audio signal must be done between blocks; otherwise, audio information represented by a partial block on either side of a cut cannot be properly recovered.

An additional limitation is imposed on editing by coding systems that process overlapping segments of program material. Because of the overlapping nature of the information represented by the encoded blocks, an original signal segment cannot properly be recovered from even a complete block of encoded samples or coefficients.

This limitation is clearly illustrated by a commonly used overlapped-block transform, a modified discrete cosine transform (ACT), that is described in Princen, Johnson, and Bradley, "Subband/Transform Coding Using Filter Bank Designs Based on Time Domain Aliasing Cancellation," ICASSP 1987 Conf. Proc., May 1987, pp. 2161–64. This particular time-domain aliasing cancellation (TDAC) transform is the time-domain equivalent of an oddly-stacked critically sampled single-sideband analysis-synthesis system and is referred to herein as Oddly-Stacked Time-Domain Aliasing Cancellation (O-TDAC).

The forward or analysis transform is applied to segments of samples that are weighted by an analysis window function and that overlap one another by one-half the segment length. The analysis transform achieves critical sampling by decimating the resulting transform coefficients by two; however, the information lost by this decimation creates time-domain aliasing in the recovered signal. The synthesis process can cancel this aliasing by applying an inverse or synthesis transform to blocks of transform coefficients to generate segments of synthesized samples, applying a suitably shaped synthesis window function to the segments of synthesized samples, and overlapping and adding the windowed segments. For example, if a TDAC analysis transform system generates a sequence of blocks $B_1$-$B_2$ from which segments $S_1$-$S_2$ are to be recovered, then the aliasing artifacts in the last half of segment $S_1$ and in the first half of segment $S_2$ will cancel each another.

If two encoded information streams from a TDAC coding system are spliced at a point between blocks, however, the segments on either side of a splice will not cancel each other's aliasing artifacts. For example, suppose one encoded information stream is cut so that it ends at a point between blocks $B_1$-$B_2$ and another encoded information stream is cut so that it begins at a point between blocks $B_3$–$B_4$. If these two encoded information streams are spliced so that block $B_1$ immediately precedes block $B_4$, then the aliasing artifacts in the last half of segment $S_1$ recovered from block $B_1$ and in the first half of segment $S_4$ recovered from block $B_4$ will generally not cancel each another.

B. Audio and Video Synchronization

Even greater limitations are imposed upon editing applications that process both audio and video information for at least two reasons. One reason is that the video frame length is generally not equal to the audio block length. The second reason pertains only to certain video standards like NTSC that have a video frame rate that is not an integer multiple of the audio sample rate. Examples in the following discussion assume an audio sample rate of 48 k samples per second. Most professional equipment uses this rate. Similar considerations apply to other sample rates such as 44.1 k samples per second, which is typically used in consumer equipment.

The frame and block lengths for several video and audio coding standards are shown in Table I and Table II, respectively. Entries in the tables for "MPEG II" and "MPEG III" refer to MPEG-2 Layer II and MPEG-2 Layer III coding techniques specified in standard ISO/IEC 13818-3 by the Motion Picture Experts Group of the International Standards Organization. The entry for "AC-3" refers to a coding technique developed by Dolby Laboratories, Inc. and specified in standard A-52 by the Advanced Television Systems Committee. The "block length" for 48 kHz PCM is the time interval between adjacent samples.

TABLE I

Video Frames

| Video Standard | Frame Length |
|---|---|
| DTV (30 Hz) | 33.333 msec. |
| NTSC | 33.367 msec. |
| PAL | 40 msec. |
| Film | 41.667 msec. |

TABLE II

Audio Frames

| Audio Standard | Block Length |
|---|---|
| PCM | 20.8 μsec. |
| MPEG II | 24 msec. |
| MPEG III | 24 msec. |
| AC-3 | 32 msec. |

In applications that bundle together video and audio information conforming to any of these standards, audio blocks and video frames are rarely synchronized. The minimum time interval between occurrences of video/audio synchronization is shown in Table III. For example, the table shows that motion picture film, at 24 frames per second, will be synchronized with an MPEG audio block boundary no more than once in each 3 second period and will be synchronized with an AC-3 audio block no more than once in each 4 second period.

TABLE III

Minimum Time Interval Between Video/Audio Synchronization

| Audio Standard | DTV (30 Hz) | NTSC | PAL | Film |
|---|---|---|---|---|
| PCM | 33.333 msec. | 166.833 msec. | 40 msec. | 41.667 msec. |
| MPEG II | 600 msec. | 24.024 sec. | 120 msec. | 3 sec. |
| MPEG III | 600 msec. | 24.024 sec. | 120 msec. | 3 sec. |
| AC-3 | 800 msec. | 32.032 sec. | 160 msec. | 4 sec. |

The minimum interval between occurrences of synchronization, expressed in numbers of audio blocks to video frames, is shown in Table IV. For example, synchronization occurs no more than once between AC-3 blocks and PAL frames within an interval spanned by 5 audio blocks and 4 video frames.

TABLE IV

Numbers of Frames Between Video/Audio Synchronization

| Audio Standard | DTV (30 Hz) | NTSC | PAL | Film |
|---|---|---|---|---|
| PCM | 1600:1 | 8008:5 | 1920:1. | 2000:1 |
| MPEG II | 25:18 | 1001:720 | 5:3 | 125:72 |
| MPEG III | 25:18 | 1001:720 | 5:3 | 125:72 |
| AC-3 | 25:24 | 1001:960 | 5:4 | 125:96 |

When video and audio information are bundled together, editing generally occurs on a video frame boundary. From the information shown in Tables III and IV, it can be seen that such an edit will rarely occur on an audio frame boundary. For NTSC video and AC-3 audio, for example, the probability that an edit on a video boundary will also occur on an audio block boundary is no more than about 1/960 or approximately 0.1 per cent. Of course, the edits for both information streams that are cut and spliced must be synchronized in this manner, otherwise some audio information will be lost; hence, it is almost certain that a splice of NTSC/AC-3 information for two random edits will occur on other than an audio block boundary and will result in one or two blocks of lost audio information. Because AC-3 uses a TDAC transform, however, even cases in which no blocks of information are lost will result in uncancelled aliasing artifacts for the reasons discussed above.

C. Segment and Block Length Considerations

In addition to the considerations affecting video/audio synchronization mentioned above, additional consideration is needed for the length of audio information segments that are encoded because this length affects the performance of video/audio systems in several ways.

One effect of segment and block length is the amount of system "latency" or delay in propagation of information through a system. Delays are incurred during encoding to receive and buffer segments of audio information and to perform the desired coding process on the buffered segments that generates blocks of encoded information. Delays are incurred during decoding to receive and buffer the blocks of encoded information, to perform the desired decoding process on the buffered blocks that recovers segments of audio information and generates an output audio signal. Propagation delays in audio encoding and decoding are undesirable because they make it more difficult to maintain an alignment between video and audio information.

Another effect of segment and block length in those systems that use block-transforms and quantization coding is the quality of the audio recovered from the encoding-decoding processes. On one hand, the use of long segment lengths allows block transforms to have a high frequency selectivity, which is desirable for perceptual coding processes because it allows perceptual coding decisions like bit allocation to be made more accurately. On the other hand, the use of long segment lengths results in the block transform having low temporal selectivity, which is undesirable for perceptual coding processes because it prevents perceptual coding decisions like bit allocation to be adapted quickly enough to fully exploit psychoacoustic characteristics of the human auditory system. In particular, the coding artifacts of highly-nonstationary signal events like transients may be audible in the recovered audio signal if the segment length exceeds the pre-temporal masking interval of the human auditory system. Thus, fixed-length coding processes must use a compromise segment length that balances requirements for high temporal resolution against requirements for high frequency resolution.

One solution is to adapt the segment length according to one or more characteristics of the audio information to be coded. For example, if a transient of sufficient amplitude is detected, a block coding processing can optimize its temporal and frequency resolution for the transient event by shifting temporarily to a shorter segment length. This adaptive process is somewhat more complicated in systems that use a TDAC transform because certain constraints must be met to maintain the aliasing-cancellation properties of the transform. A number of considerations for adapting the length of TDAC transforms are discussed in U.S. Pat. No. 5,394,473, which is incorporated herein by reference.

DISCLOSURE OF INVENTION

In view of the several considerations mentioned above, it is an object of the present invention to provide for the encoding and decoding of audio information that is conveyed in frames aligned with video information frames, and that permits block coding processes including time-domain aliasing cancellation transforms to adapt segment and block lengths according to signal characteristics.

Additional advantages that may be realized from various aspects of the present invention include avoiding or at least minimizing audible artifacts that result from editing operations like splicing, and controlling processing latency to more easily maintain video/audio synchronization.

According to the teachings of one aspect of the present invention, a method for encoding audio information comprises receiving a reference signal conveying the alignment of video information frames in a sequence of video information frames; receiving an audio signal conveying audio information; analyzing the audio signal to identify characteristics of the audio information; generating a control signal in response to the characteristics of the audio information; applying an adaptive block encoding process to overlapping segments of the audio signal to generate a plurality of blocks of encoded information, wherein the block encoding process adapts segment lengths in response to the control signal; and assembling the plurality of blocks of encoded information and control information conveying the segment lengths to form an encoded information frame that is aligned with the reference signal.

According to the teachings of another aspect of the present invention, a method for decoding audio information comprises receiving a reference signal conveying the alignment of video information frames in a sequence of video information frames; receiving encoded information frames that are aligned with the reference signal and comprise control information and blocks of encoded audio information; generating a control signal in response to the control information; applying an adaptive block decoding process to the plurality of blocks of encoded audio information in a respective encoded information frame, wherein the block decoding process adapts in response to the control signal to generate a sequence of overlapping segments of audio information.

According to the teachings of yet another aspect of the present invention, an information storage medium such as optical disc, magnetic disk and tape carries video information arranged in video frames and encoded audio information arranged in encoded information frames, wherein a respective encoded information frame corresponds to a respective video frame and includes control information conveying lengths of segments of audio information in a sequence of overlapping segments, a respective segment having a respective overlap interval with an adjacent segment and the sequence having a length equal to the frame interval plus a frame overlap interval, and blocks of encoded audio information, a respective block having a respective length and respective content that, when processed by an adaptive block-decoding process, results in a respective segment of audio information in the sequence of overlapping segments.

Throughout this discussion, terms such as "coding" and "coder" refer to various methods and devices for signal processing and other terms such as "encoded" and "decoded" refer to the results of such processing. These terms are often understood to refer to or imply processes like perceptual-based coding processes that allow audio information to be conveyed or stored with reduced information capacity requirements. As used herein, however, these terms do not imply such processing. For example, the term "coding" includes more generic processes such as generating pulse code modulation (PCM) samples to represent a signal and arranging or assembling information into formats according to some specification.

Terms such as "segment," "block" and "frame" as used in this disclosure refer to groups or intervals of information that may differ from what those same terms refer to in other references such as the ANSI S4.40-1992 standard, sometimes known as the AES-3/EBU digital audio standard.

Terms such as "filter" and "filterbank" as used herein include essentially any form of recursive and non-recursive filtering such as quadrature mirror filters (QMF). Unless the context of the discussion indicates otherwise, these terms are also used herein to refer to transforms. The term "filtered" information refers to the result of applying analysis "filters."

The various features of the present invention and its preferred embodiments may be better understood by referring to the following discussion and the accompanying drawings in which like reference numerals refer to like elements in the several figures.

The drawings which illustrate various devices show major components that are helpful in understanding the present invention. For the sake of clarity, these drawings omit many other features that may be important in practical embodiments but are not important to understanding the concepts of the present invention.

The signal processing required to practice the present invention may be accomplished in a wide variety of ways including programs executed by microprocessors, digital signal processors, logic arrays and other forms of computing circuitry. Machine executable programs of instructions that implement various aspects of the present invention may be embodied in essentially any machine-readable medium including magnetic and optical media such as optical discs, magnetic disks and tape, and solid-state devices such as programmable read-only-memory. Signal filters may be implemented in essentially any way including recursive, non-recursive and lattice digital filters. Digital and analog technology may be used in various combinations according to needs and characteristics of the application.

More particular mention is made of conditions pertaining to processing audio and video information streams; however, aspects of the present invention may be practiced in applications that do not include the processing of video information.

The contents of the following discussion and the drawings are set forth as examples only and should not be understood to represent limitations upon the scope of the present invention.

MODES FOR CARRYING OUT THE INVENTION

A. Signals and Processing

1. Segments, Blocks and Frames

Figure 1:
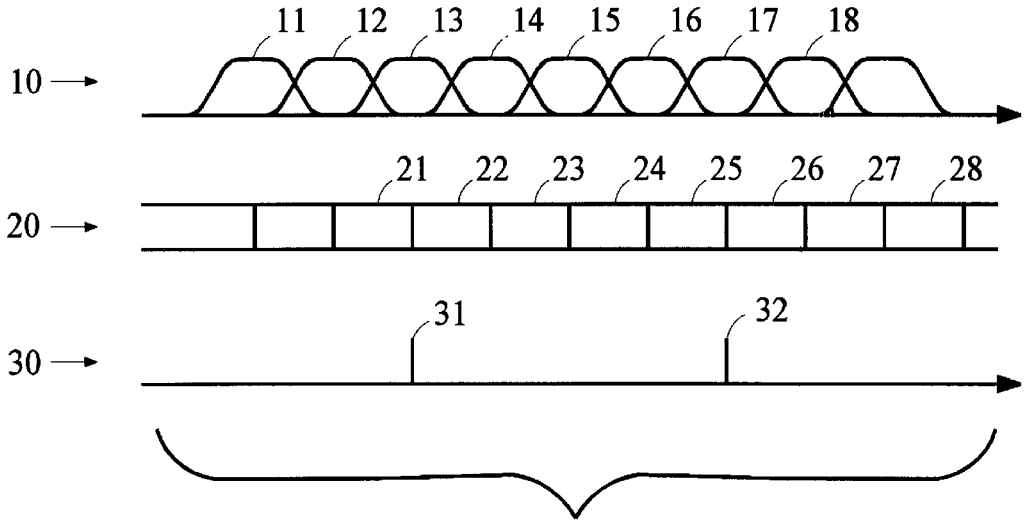
FIG. 1 is a schematic representation of audio information arranged in segments and encoded information arranged in blocks that are aligned with a reference signal.

The present invention pertains to encoding and decoding audio information that is related to pictures conveyed in frames of video information. Referring to FIG. 1, a portion of audio signal 10 for one channel of audio information is shown partitioned into overlapping segments 11 through 18. According to the present invention, segments of one or more channels of audio information are processed by a block-encoding process to generate encoded information stream 20 that comprises blocks 21 through 28 of encoded information. For example, a sequence of encoded blocks 22 through 25 is generated by applying a block-encoding process to the sequence of audio segments 12 through 15 for one channel of audio information. As shown in the figure, a respective encoded block lags the corresponding audio segment because the block-encoding process incurs a delay that is at least as long as the time required to receive and buffer a complete audio segment. The amount of lag illustrated in the figure is not intended to be significant.

Each segment in audio signal 10 is represented in Fig. #1 by a shape suggesting the time-domain "gain profile" of an analysis window function that may be used in a block-encoding process such as transform coding. The gain profile of an analysis window function is the gain of the window function as a function of time. The gain profile of the window function for one segment overlaps the gain profile of the window function for a subsequent segment by an amount referred to herein as the segment overlap interval. Although it is anticipated that transform coding will be used in preferred embodiments, the present invention may be used with essentially any type of block-encoding process that generates a block of encoded information in response to a segment of audio information.

Reference signal 30 conveys the alignment of video frames in a stream of video information. In the example shown, frame references 31 and 32 convey the alignment of two adjacent video frames. The references may mark the beginning or any other desired point of a video frame. One commonly used alignment point for NTSC video is the tenth line in the first field of a respective video frame.

The present invention may be used in video/audio systems in which audio information is conveyed with frames of video information. The video/audio information streams are frequently subjected to a variety of editing and signal processing operations. These operations frequently cut one or more streams of video/audio information into sections at points that are aligned with the video frames; therefore, it is desirable to assemble the encoded audio information into a form that is aligned with the video frames so that these operations do not make a cut within an encoded block.

Figure 2:
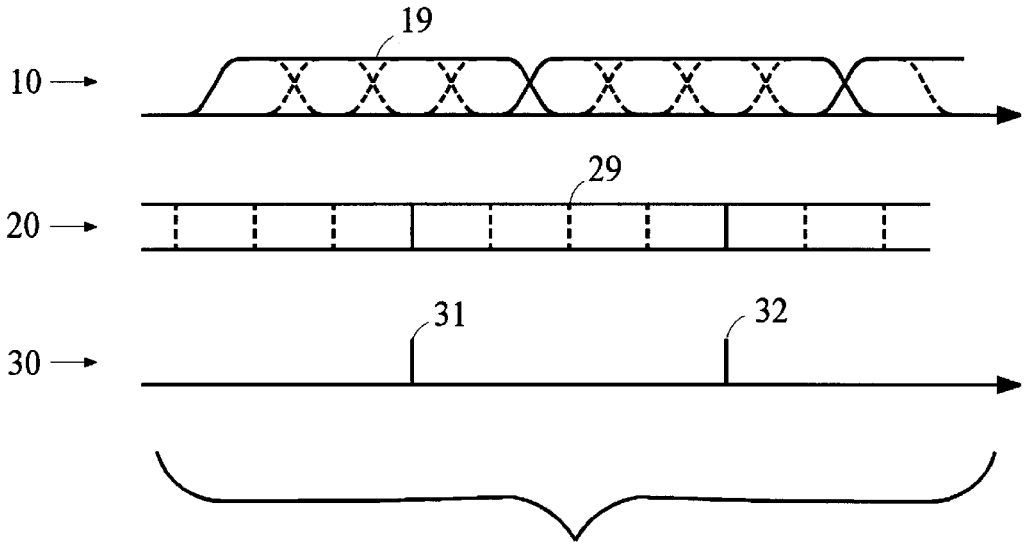
FIG. 2 is a schematic illustration of segments of audio information arranged in a frame and blocks of encoded information arranged in a frame that is aligned with a reference signal.

Referring to FIG. 2, a sequence or frame 19 of segments for one channel of audio information is processed to generate a plurality of encoded blocks that are assembled into frame 29, which is aligned with reference 31. In this figure, broken lines represent the boundaries of individual segments and blocks and solid lines represent the boundaries of segment frames and encoded-block frames. In particular, the shape of the solid line for segment frame 19 suggests the resulting time-domain gain profile of the analysis window functions for a sequence of overlapped segments within the frame. The amount by which the gain profile for one segment frame such as frame 19 overlaps the gain profile of a subsequent segment frame is referred to herein as the frame overlap interval.

In embodiments that use analysis window functions and transforms, the shape of the analysis window functions affect the time-domain gain of the system as well as the frequency-response characteristics of the transform. The choice of window function can have a significant effect on the performance of a coding system; however, no particular window shape is critical in principle to the practice of the present invention. Information describing the effects of window functions may be obtained from U.S. Pat. No. 5,109,417, incorporated herein by reference, from U.S. Pat. No. 5,394,473, and from U.S. patent application Ser. No. 08/953,121 entitled "Frame-Based Audio Coding With Additional Filterbank to Suppress Aliasing Artifacts at Frame Boundaries," filed Oct. 17, 1997, and U.S. patent application Ser. No. 08/953,106 entitled "Frame-Based Audio Coding With Additional Filterbank to Attenuate Spectral Splatter at Frame Boundaries," filed Oct. 17, 1997,.

In practical embodiments, a gap or "guard band" is formed between frames of encoded information to provide some tolerance for making edits and cuts. Additional information on the formation of these guard bands may be obtained from U.S. patent application Ser. No. 09/042,367 entitled "Using Time-Aligned Blocks of Encoded Audio in Video/Audio Applications to Facilitate Audio Switching," filed Mar. 13, 1998. Ways in which useful information may be conveyed in these guard bands are disclosed in U.S. patent application Ser. No. 09/193,186 entitled "Providing Auxiliary Information With Frame-Based Encoded Audio Information," filed Nov. 17, 1998, which is incorporated herein by reference.

2. Overview of Signal Processing

Audio signals are generally not stationary although some passages of audio can be substantially stationary. These passages can often be block-encoded more effectively using longer segment lengths. For example, encoding processes like block-companded PCM can encode stationery passages of audio to a given level of accuracy with fewer bits by encoding longer segments of samples. In psychoacoustic-based transform coding systems, the use of longer segments increases the frequency resolution of the transform for more accurate separation of individual spectral components and more accurate psychoacoustic coding decisions.

Unfortunately, these advantages are not present for passages of audio that are highly non-stationary. In passages that contain a large amplitude transient, for example, block-companded PCM coding of a long segment is very inefficient. In psychoacoustic-based transform coding systems, artifacts caused by quantization of transient spectral components are spread across the segment that is recovered by the synthesis transform; if the segment is long enough, these artifacts are spread across an interval that exceeds the pre-temporal masking interval of the human auditory system. Consequently, shorter segment lengths are usually preferred for passages of audio that are highly non-stationary.

Coding system performance can be improved by adapting the coding processes to encode and decode segments of varying lengths. For some coding processes, however, changes in segment length must conform to one or more constraints. For example, the adaptation of coding processes that use a time-domain aliasing cancellation (TDAC) transform must conform to several constraints if aliasing cancellation is to be achieved. Embodiments of the present invention that satisfy TDAC constraints are described herein.

a. Encoding

Figure 3:
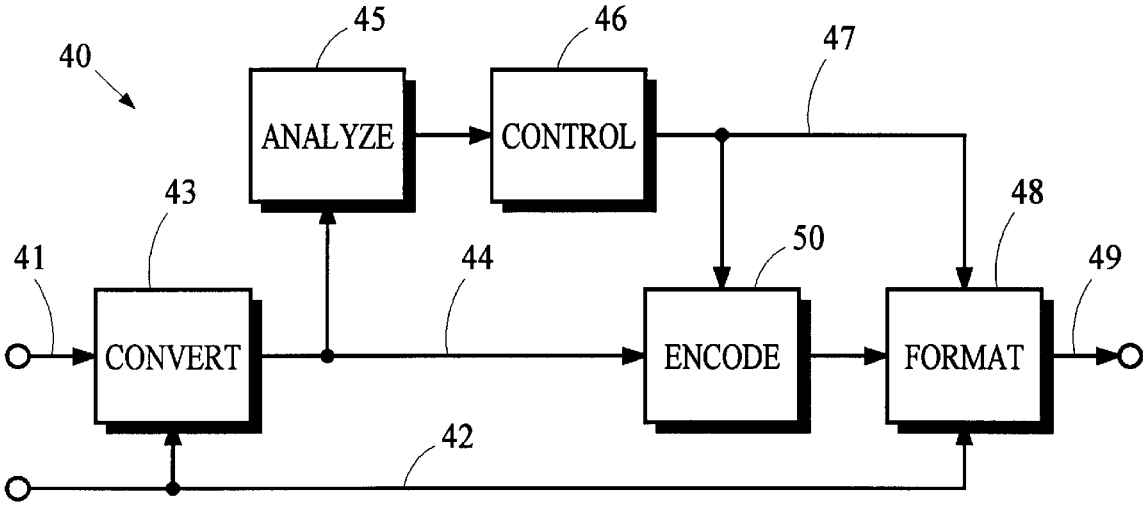
FIG. 3 is a block diagram of one embodiment of an audio encoder that applies an adaptive block-encoding process to segments of audio information.

FIG. 3 illustrates one embodiment of audio encoder 40 that applies an adaptive block-encoding process to sequences or frames of segments of audio information for one or more audio channels to generate blocks of encoded audio information that are assembled into frames of encoded information. These encoded-block frames can be combined with or embedded into frames of video information.

In this embodiment, analyze 45 identifies characteristics of the one or more audio signals conveyed by the audio information that is passed along path 44. Examples of these characteristics include rapid changes in amplitude or energy for all or a portion of the bandwidth of each audio signal, components of signal energy that experience a rapid change in frequency, and the time or relative location within a section of a signal where such events occur. In response to these detected characteristics, control 46 generates along path 47 a control signal that conveys the lengths of segments in a frame of segments to be processed for each audio channel. Encode 50 adapts a block-encoding process in response to the control signal received from path 47 and applies the adapted block-encoding process to the audio information received from path 44 to generate blocks of encoded audio information. Format 48 assembles the blocks of encoded information and a representation of the control signal into a frame of encoded information that is aligned with a reference signal received from path 42 that conveys the alignment of frames of video information. Convert 43 is an optional component that is described in more detail below.

In embodiments of encoder 40 that process more than one channel of audio information, encode 50 may adapt and apply a signal encoding process to some or all of the audio channels. In preferred embodiments, however, analyze 45, control 46 and encode 50 operate to adapt and apply an independent encoding process for each audio channel. In one preferred embodiment, for example, encoder 40 adapts the block length of the encoding process applied by encode 50 to only one audio channel in response to detecting the occurrence of a transient in that audio channel. In these preferred embodiments, the detection of a transient in one audio channel is not used to adapt the encoding process of another channel.

b. Decoding

Figure 4:
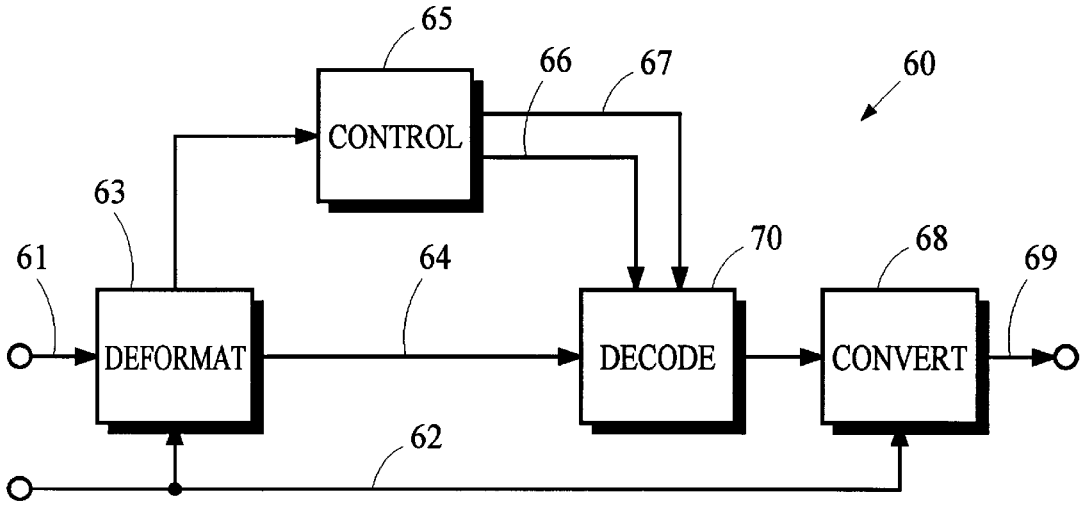
FIG. 4 is a block diagram of one embodiment of an audio decoder that generates segments of audio information by applying an adaptive block-decoding process to frames of encoded information.

FIG. 4 illustrates one embodiment of audio decoder 60 that generates segments of audio information for one or more audio channels by applying an adaptive block-decoding process to frames of encoded information that can be obtained from signals carrying frames of video information.

In this embodiment, deformat 63 receives frames of encoded information that are aligned with a video reference received from path 62. The frames of encoded information convey control information and blocks encoded audio information. Control 65 generates along path 67 a control signal that conveys the lengths of segments of audio information in a frame of segments to be recovered from the blocks of encoded audio information. Optionally, control 65 also detects discontinuities in the frames of encoded information and generates along path 66 a "splice-detect" signal that can be used to adapt the operation of decode 70. Decode 70 adapts a block-decoding process in response to the control signal received from path 67 and optionally the splice-detect signal received from path 66, and applies the adapted block-decoding process to the blocks of encoded audio information received from path 64 to generate segments of audio information having lengths that conform to the lengths conveyed in the control signal. Convert 68 is an optional component that is described in more detail below.

B. Transform Coding Implementations

1. Block Encoder

As mentioned above, encode 50 may perform a wide variety of block-encoding processes including block-companded PCM, delta modulation, filtering such as that provided by Quadrature Mirror Filters (QMF) and a variety of recursive, non-recursive and lattice filters, block transformation such as that provided by TDAC transforms, discrete Fourier transforms (DFT) and discrete cosine transforms (DCT), and wavelet transforms, and block quantization according to adaptive bit allocation. Although no particular block-encoding process is essential to the basic concept of the present invention, more particular mention is made herein to processes that apply TDAC transforms because of the additional considerations required to achieve aliasing cancellation.

Figure 5:
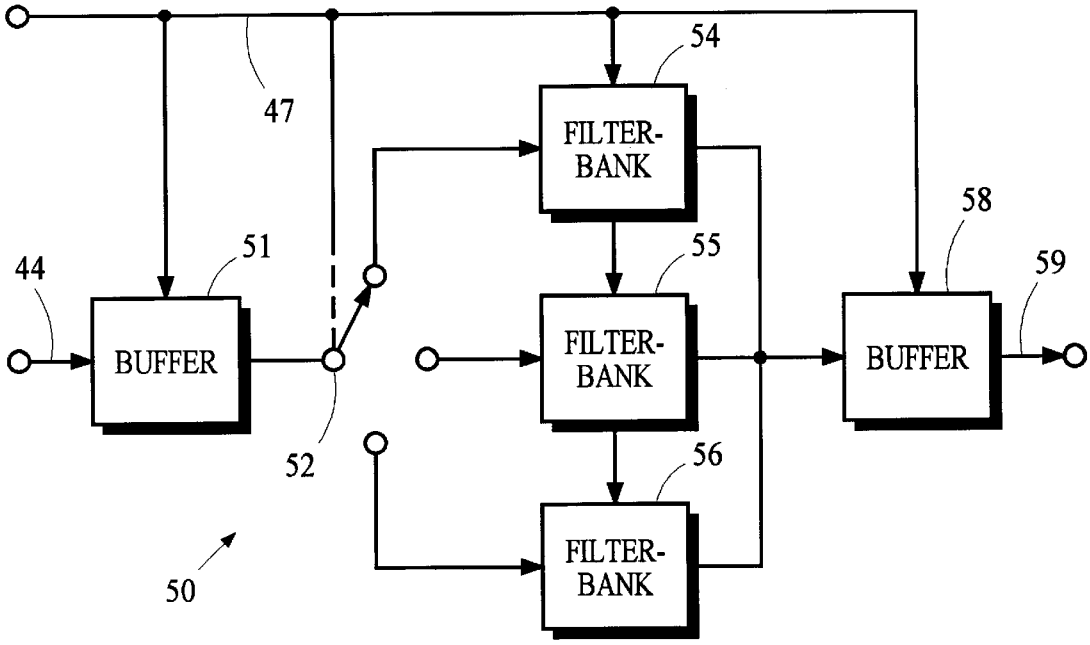
FIG. 5 is a block diagram of one embodiment of a block encoder that applies one of a plurality of filterbanks to segments of audio information.

FIG. 5 illustrates one embodiment of encoder 50 that applies one of a plurality of filterbanks implemented by TDAC transforms to segments of audio information for one audio channel. In this embodiment, buffer 51 receives audio information from path 44 and assembles the audio information into a frame of overlapping segments having lengths that are adapted according to the control signal received from path 47. The amount by which a segment overlaps an adjacent segment is referred to as the segment overlap interval. Switch 52 selects one of a plurality of filterbanks to apply to the segments in the frame in response to the control signal received from path 47. The embodiment illustrated in the figure shows three filterbanks; however, essentially any number of filterbanks may be used.

In one implementation, switch 51 selects filterbank 54 for application to the first segment in the frame, selects filterbank 56 for application to the last segment in the frame, and selects filterbank 55 for application to all other segments in the frame. Additional filterbanks may be incorporated into the embodiment and selected for application to segments near the first and last segments in the frame. Some of the advantages that may be achieved by adaptively selecting filterbanks in this manner are discussed below. The information obtained from the filterbanks is assembled in buffer 58 to form blocks of encoded information, which are passed along path 59 to format 48. The size of the blocks varies according to the control signal received from path 47.

A variety of components for psychoacoustic perceptual models, adaptive bit allocation and quantization may be necessary in practical systems but are not included in the figure for illustrative clarity. Components such as these may be used but are not required to practice the present invention.

In an alternative embodiment of encode 50, a single filterbank is adapted and applied to the segments of audio information formed in buffer 51. In other embodiments of encode 50 that use non-overlapping block-encoding processes like block-encoded PCM or some filters, adjacent segments need not overlap.

The components illustrated in FIG. 5 or the components comprising various alternate embodiments may be replicated to provide parallel processing for multiple audio channels, or these components may be used to process multiple audio channels in a serial or multiplexed manner.

2. Block Decoder

As mentioned above, decode 70 may perform a wide variety of block-decoding processes. In a practical system, the decoding process should be complementary to the block-encoding process used to prepare the information to be decoded. As explained above, more particular mention is made herein to processes that apply TDAC transforms because of the additional considerations required to achieve aliasing cancellation.

Figure 6:
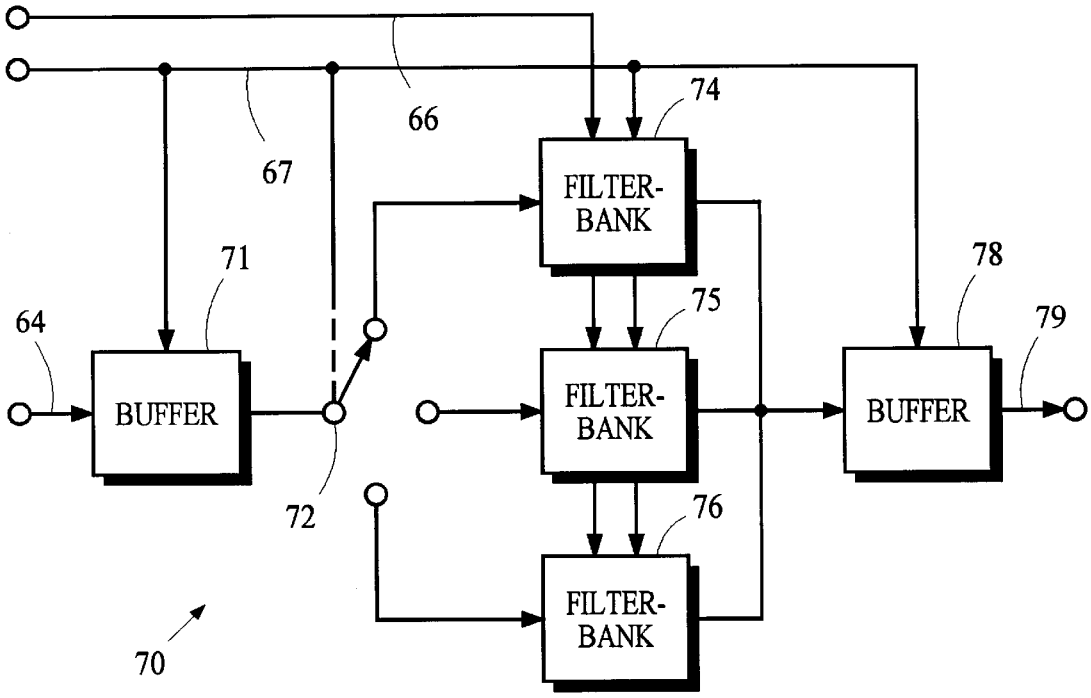
FIG. 6 is a block diagram of one embodiment of a block decoder that applies one of a plurality of synthesis filterbanks to blocks of encoded audio information.

FIG. 6 illustrates one embodiment of decoder 70 that applies one of a plurality of inverse or synthesis filterbanks implemented by TDAC transforms to blocks of encoded audio information for one audio channel. In this embodiment, buffer 71 receives blocks of encoded audio information from path 64 having lengths that vary according to the control signal received from path 67. Switch 72 selects one of a plurality of synthesis filterbanks to apply to the blocks of encoded information in response to the control signal received from path 67 and optionally in response to a splice-detect signal received from path 67. The embodiment illustrated in the figure shows three synthesis filterbanks; however, essentially any number of filterbanks may be used.

In one implementation, switch 71 selects synthesis filterbank 74 for application to the block representing the first audio segment in a frame of segments, selects synthesis filterbank 56 for application to the block representing the last segment in the frame, and selects filterbank 55 for application to the block s representing all other segments in the frame. Additional filterbanks may be incorporated into the embodiment and selected for application to blocks representing segments that are near the first and last segments in the frame. Some of the advantages achieved by adaptively selecting synthesis filterbanks in this manner are discussed below. The information obtained from the synthesis filterbanks is assembled in buffer 78 to form overlapping segments of audio information in the frame of segments. The lengths of the segments vary according to the control signal received from path 67. Adjacent segments may be added together in the segment overlap intervals to generate a stream of audio information along path 79. For example, the audio information may be passed along path 79 to convert 68 in embodiments that include convert 68.

A variety of components for adaptive bit allocation and dequantization may be necessary in practical systems but are not included in the figure for illustrative clarity. Features such as these may be used but are not required to practice the present invention.

In an alternative embodiment of decode 70, a single inverse filterbank is adapted and applied to blocks of encoded information formed in buffer 71. In other embodiments of decode 70, adjacent segments generated by the decoding process need not overlap.

The components illustrated in FIG. 6 or the components comprising various alternate embodiments may be replicated to provide parallel processing for multiple audio channels, or these components may be used to process multiple audio channels in a serial or multiplexed manner.

C. Major Components and Features

Specific embodiments of the major components in encoder 40 and decoder 60 illustrated in FIGS. 3 and 4, respectively, are described below in more detail. These particular embodiments are described with reference to one audio channel but they may be extended to process multiple audio channels in a number of ways including, for example, the replication of components or the application of components in a serial or multiplexed fashion.

In the following examples, a frame or sequence of segments of audio information is assumed to have a length equal to 2048 samples and a frame overlap interval with a succeeding frame equal to 256 samples. This frame length and frame overlap interval are preferred for systems that process information for video frames having a frame rate of about 30 Hz or less.

1. Audio Signal Analysis

Figure 7:
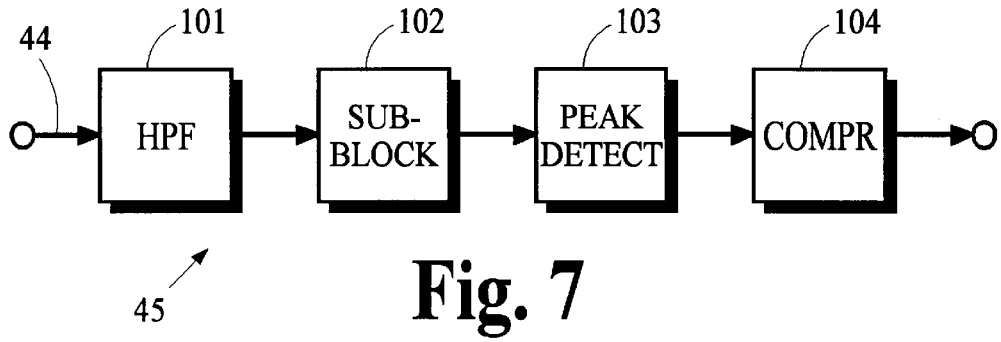
FIG. 7 is a block diagram of a transient detector that may be used to analyze segments of audio information.

Analyze 45 may be implemented in a wide variety of ways to identify essentially any desired signal characteristics. In one embodiment illustrated in FIG. 7, analyze 45 is a transient detector with four major sections that identify the occurrence and position of "transients" or rapid changes in signal amplitude. In this embodiment, frames of 2048 samples of audio information are partitioned into thirty-two non-overlapping 64-sample blocks, and each block is analyzed to determine whether a transient occurs in that block.

The first section of the transient detector is high-pass filter (HPF) 101 that excludes lower frequency signal components from the signal analysis process. In a preferred embodiment, HPF 101 is implemented by a second order infinite impulse response (IIR) filter with a nominal 3 dB cutoff frequency of about 7 kHz. The optimum cutoff frequency may deviate from this nominal value according to personal preferences. If desired, the nominal cutoff frequency may be refined empirically with listening tests.

The second section of the transient detector is subblock 102, which arranges frames of filtered audio information received from HPF 101 into a hierarchical structure of blocks and subblocks. Subblock 102 forms 64-sample blocks in level 1 of the hierarchy and divides the 64-sample blocks into 32-sample subblocks in level 2 of the hierarchy.

Figure 8:
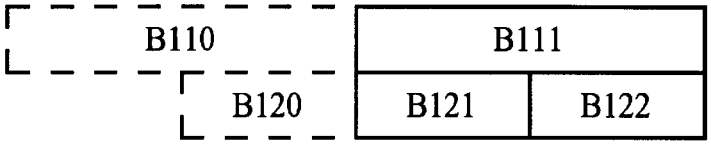
FIG. 8 illustrates a hierarchical structure of blocks and subblocks used by the transient detector of FIG. 7.

This hierarchical structure is illustrated in FIG. 8. Block B111 is a 64-sample block in level 1. Subblocks B121 and B122 in level 2 are 32-sample partitions of block B111. Block B110 represents a 64-sample block of filtered audio information that immediately precedes block B111. In this context, block B111 is a "current" block and block B110 is a "previous" block. Similarly, block B120 is a 32-sample subblock of block B110 that immediately precedes subblock B121. In instances where the current block is the first block in a frame, the previous block represents the last block in the previous frame. As will be explained below, a transient is detected by comparing signal levels in a current block with signal levels in a previous block.

The third section of the transient detector is peak detect 103. Starting in level 2, peak detect 103 identifies the largest magnitude sample in subblock B121 as peak value P121, and identifies the largest magnitude sample in subblock B122 as peak value P122. Continuing in level 1, the peak detector identifies the larger of peak values P121 and P122 as the peak value P111 of block B111. The peak values P110 and P120 for blocks B110 and B120, respectively, were determined by peak detect 103 previously when block B110 was the current block.

Figure 9:
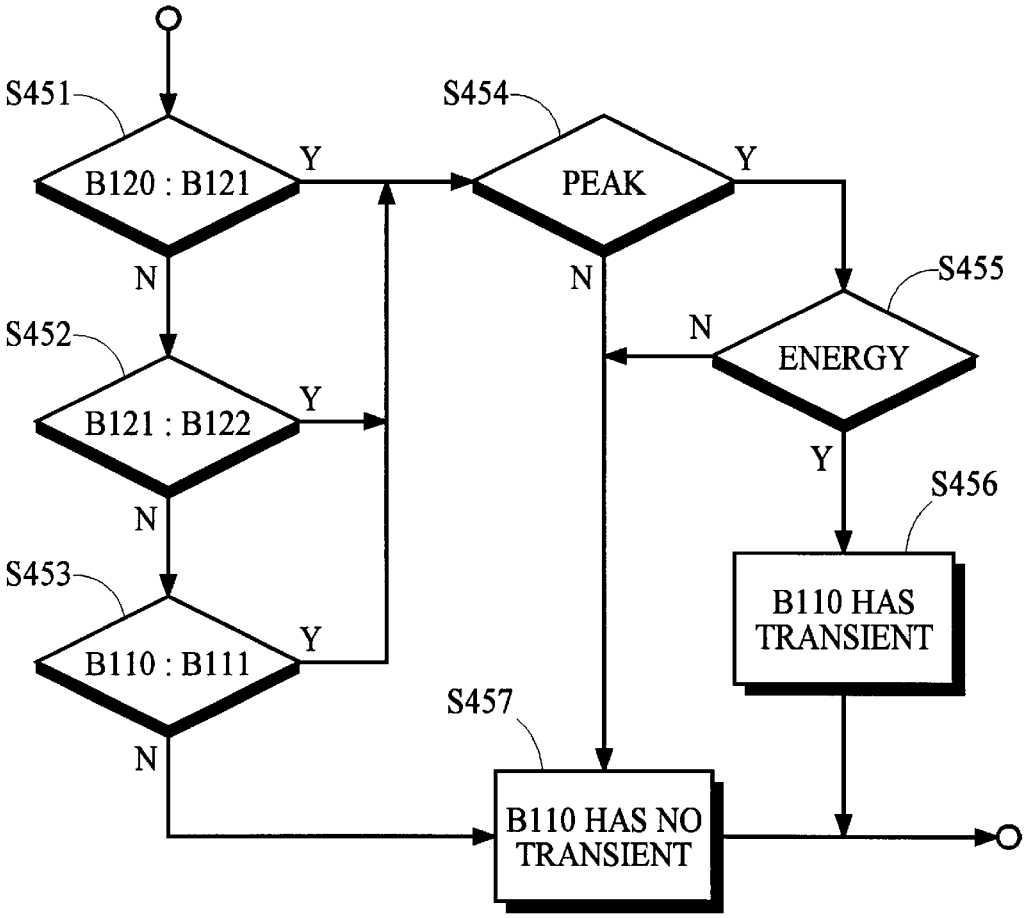
FIG. 9 illustrates steps in a method for implementing the comparator in the transient detector of FIG. 7.

The fourth section of the transient detector is comparator 104, which examines peak values to determine whether a transient occurs in a particular block. One way in which comparator 104 may be implemented is illustrated in FIG. 9. Step S451 examines the peak values for subblocks B120 and B121 in level 2. Step S452 examines the peak values for subblocks B121 and B122. Step S453 examines the peak values for the blocks in level 1. These examinations are accomplished by comparing the ratio of the two peak values with a threshold value that is appropriate for the hierarchical level. For subblocks B120 and B121 in level 2, for example, this comparison in step S451 may be expressed as $$\frac{P120}{P121} < TH2 \tag{1 a}$$

where TH2=threshold value for level 2. If necessary, a similar comparison in step S452 is made for the peak values of subblocks B121 and B122.

If neither comparison in steps S451 and S452 for adjacent subblocks in level 2 is true, then a comparison is made in step S453 for the peak values of blocks B110 and B111 in level 1. This may be expressed as $$\frac{P110}{P111} < TH1 \tag{1 b}$$

where TH1=threshold value for level 1.

In one embodiment, TH2 is 0.15 and TH1 is 0.25; however, these thresholds may be varied according to personal preferences. If desired, these values may be refined empirically with listening tests.

In a preferred implementation, these comparisons are performed without division because a quotient of two peak values is undefined if the peak value in the denominator is zero. For the example given above for subblocks B120 and B121, the comparison in step S451 may be expressed as $$P120 < TH2 * P121 \tag{2}$$

If none of the comparisons made in steps S451 through S453 are true, step S457 generates a signal indicating that no transient occurs in the current 64-sample block which in this example is block B111. Signal analysis for the current 64-sample block is finished.

If any of the comparisons made in steps S451 through S453 are true, steps S454 and S455 determine whether the signal in the current 64-sample block is large enough to justify adapting the block-encoding process to change segment length. Step S454 compares the peak value P111 for current block B111 with a minimum peak-value threshold. In one embodiment, this threshold is set at −70 dB relative to the maximum possible peak value.

If the condition tested in step S454 is true, step S455 compares two measures of signal energy for blocks B110 and B111. In one embodiment, the measure of signal energy for a block is the mean of the squares of the 64 samples in the block. The measure of signal energy for current block B111 is compared with a value equal to twice the same measure of signal energy for previous block B110. If the peak value and measure of signal energy for the current block pass the two tests made in steps S454 and 455, step S457 generates a signal that indicates a transient occurs in current block B111. If either test fails, step S457 generates a signal indicating no transient occurs in current block B111.

This transient-detection process is repeated for all blocks of interest in each frame.

2. Segment Length Control

Embodiments of control 46 and control 65 will now be described. These embodiments are suitable for use in systems that apply TDAC filterbanks to process frames of encoded audio information according to the second of two formats described below. As explained below, processing according to the second format is preferred in systems that process audio information that is assembled with or embedded into video frames that are intended for transmission at a video frame rate of about 30 Hz or less. According to the second format, the processing of each sequence of audio segments that corresponds to a video frame is partitioned into separate but related processes that are applied to two subsequences or subframes.

The control schemes for systems that process frames of audio information according to the first format may be very similar to the control schemes discussed below. In these systems, the processing of audio segments corresponding to a video frame is substantially the same as one of the processes applied to a respective subsequence or subframe.

a. Encoder

In the embodiment of encoder 40 that is described above and illustrated in FIG. 3, control 46 receives a signal from analyzer 45 conveying the presence and location of transients detected in a frame of audio information. In response to this signal, control 46 generates a control signal that conveys the lengths of segments that divide the frame into two subframes of overlapping segments to be processed by a block-encoding process.

Two schemes for adapting a block-encoding process are described below. In each scheme, frames of 2048 samples are partitioned into overlapping segments having lengths that vary between a minimum length of 256 samples and an effective maximum length of 1152 samples.

Figure 10:
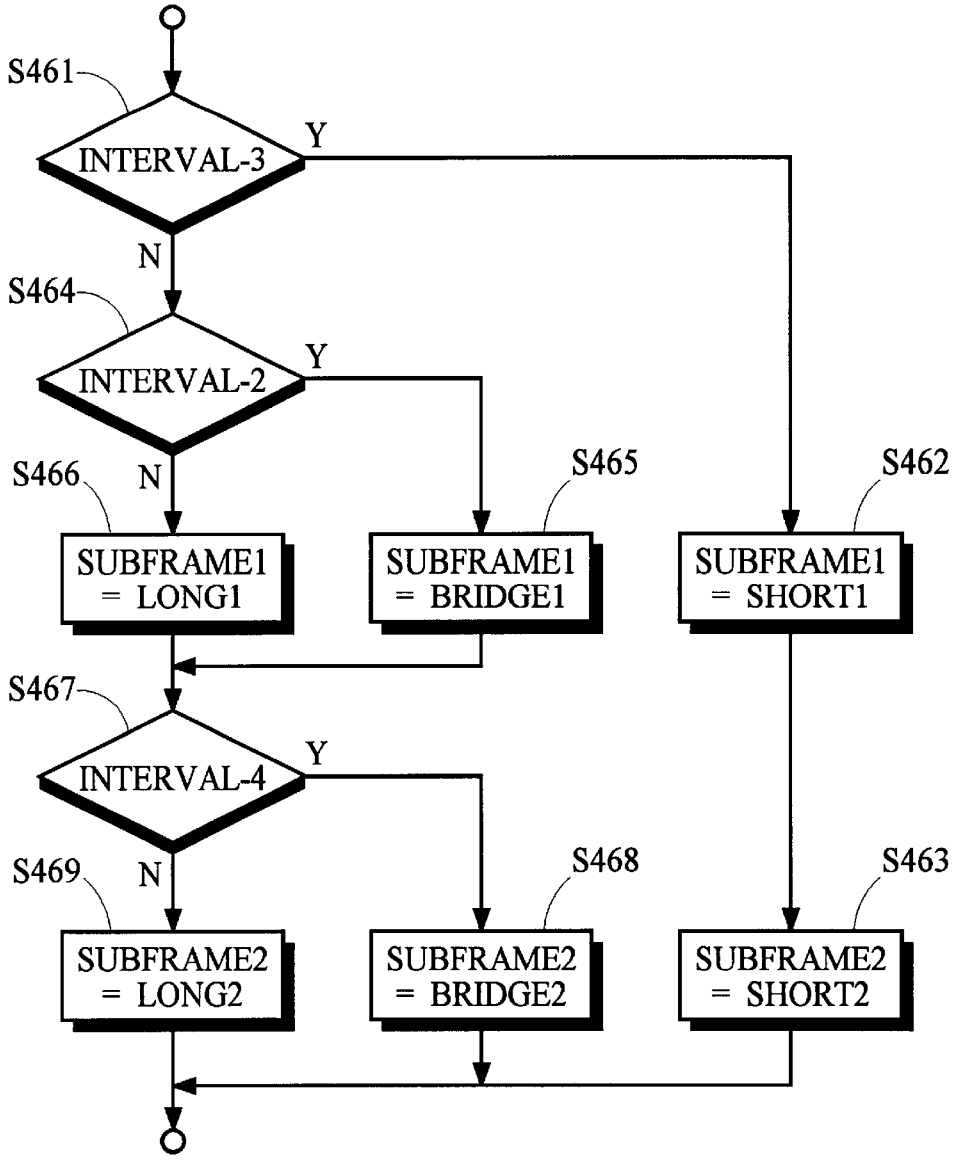
FIG. 10 illustrates steps in a method for controlling a block-encoding process.

One basic control method such as that illustrated in FIG. 10 may be used to control either scheme. The only differences in the methods for controlling the two schemes are the blocks or frame intervals in which the occurrence of a transient is tested. The intervals for the two schemes are listed in Table V. In the first scheme, for example, interval-2 extends from sample 128 to sample 831, which corresponds to a sequence of 64-sample blocks from block number 2 to block number 12. In the second scheme, interval-2 extends from sample 128 to sample 895, which corresponds to block numbers 2 to 13.

TABLE V

Frame Intervals for Coding Control

| Frame | First Scheme | | | | Second Scheme | | | |
|---|---|---|---|---|---|---|---|---|
| | Samples | | Blocks | | Samples | | Blocks | |
| Interval | From | To | From | To | From | To | From | To |
| Interval-1 | 0 | 127 | 0 | 1 | 0 | 127 | 0 | 1 |
| Interval-2 | 128 | 831 | 2 | 12 | 128 | 895 | 2 | 13 |
| Interval-3 | 832 | 1343 | 13 | 20 | 896 | 1279 | 14 | 19 |
| Interval-4 | 1344 | 2047 | 21 | 31 | 1280 | 2047 | 20 | 31 |

Referring to FIG. 10, step S461 examines the signal received from analyze 45 to determine whether a transient or some other triggering event occurs in any block within interval-3. If this condition is true, step S462 generates a control signal indicating the first subframe is divided into segments according to a "short-1" pattern of segments, and step S463 generates a signal indicating the second subframe is divided into segments according to a "short-2" pattern of segments.

If the condition that is tested in step S461 is not true, step S464 examines the signal received from analyze 45 to determine whether a transient or other triggering event occurs in any block within interval-2. If this condition is true, step S465 generates a control signal indicating the first subframe is divided into segments according to a "bridge-1" pattern of segments. If the condition tested in step S463 is not true, step S466 generates a control signal indicating the first subframe is divided into segments according to a "long-1" pattern of segments.

Step S467 examines the signal received from analyze 45 to determine whether a transient or other triggering event occurs in any block within interval-4. If this condition is true, step S468 generates a control signal indicating the second subframe is divided into segments according to a "bridge-2" pattern of segments. If the condition tested in step S467 is not true, step S469 generates a control signal indicating the second subframe is divided into segments according to a "long-2" pattern of segments.

The patterns of segments mentioned above are discussed in more detail below.

b. Decoder

In the embodiment of decoder 60 that is described above and illustrated in FIG. 4, control 65 receives control information obtained from the frames of encoded information received from path 61 and, in response, generates a control signal along path 67 that conveys the lengths of segments of audio information to be recovered by a block-decoding process from blocks of encoded audio information. In an alternative embodiment, control 65 also detects discontinuities in the frames of encoded information and generates a "splice-detect" signal along path 66 that can be used to adapt the block-decoding process. This optional feature is discussed below.

In general, control 65 generates a control signal that indicates which of several patterns of segments are to be recovered from two subframes of encoded blocks. These patterns of segments correspond to the patterns discussed above in connection with the encoder and are discussed in more detail below.

3. Adaptive Filterbanks

Embodiments of encoder 50 and decoder 70 that apply TDAC filterbanks to analyze and synthesize overlapping segments of audio information will now be described. The embodiments described below use the TDAC transform system known as Oddly-Stacked Time-Domain Aliasing Cancellation (O-TDAC). In these embodiments, window functions and transform kernel functions are adapted to process sequences or subframes of segments in which segment lengths may vary according to any of several patterns mentioned above. The segment length, window function and transform kernel function used for each segment in the various patterns is described below following a general introduction to the TDAC transform.

a. TDAC Overview (1) Transforms

Figure 11:
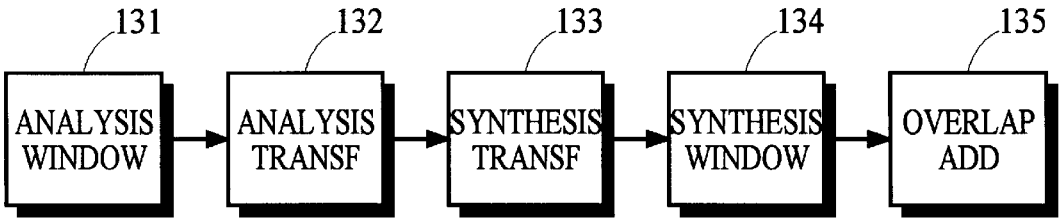
FIG. 11 is a block diagram of a time-domain aliasing cancellation analysis-synthesis system.

As taught by Princen, et al., and as illustrated in FIG. 11, a TDAC transform analysis-synthesis system comprises an analysis window function 131 that is applied to overlapped segments of signal samples, an analysis transform 132 that is applied to the windowed segments, a synthesis transform 133 that is applied to blocks of coefficients obtained from the analysis transform, a synthesis window function 134 that is applied to segments of samples obtained from the synthesis transform, and overlap-add process 135 that adds corresponding samples of overlapped windowed segments to cancel time-domain aliasing and recover the original signal.

The forward or analysis O-TDAC transform may be expressed as $$X(k) = \frac{G}{N}\sum_{n=0}^{N-1} x(n)\cos\left[\frac{2\pi}{N}\left(k+\frac{1}{2}\right)(n+n_0)\right] \text{ for } 0 \le k < N \tag{3a}$$

and the inverse or synthesis O-TDAC transform may be expressed as $$x(n) = \sum_{k=0}^{N-1} X(k)\cos\left[\frac{2\pi}{N}\left(k+\frac{1}{2}\right)(n+n_0)\right] \text{ for } 0 \le n < N \tag{3b}$$

where k=frequency index, n=signal sample number,

G=scaling constant,

N=segment length, n=term for aliasing cancellation, x(n)=windowed input signal sample n, and X(k)=transform coefficient k.

These transforms are characterized by the G, N and $n_0$ parameters. The G parameter is a gain parameter that is used to achieve a desired end-to-end gain for the analysis-synthesis system. The N parameter pertains to the number of samples in each segment, or the segment length, and is generally referred to as the transform length. As mentioned above, this length may be varied to balance the frequency and temporal resolutions of the transforms. The no parameter controls the aliasing-generation and aliasing-cancellation characteristics of the transforms.

The time-domain aliasing artifacts that are generated by the analysis-synthesis system are essentially time-reversed replicas of the original signal. The $n_0$ terms in the analysis and synthesis transforms control the "reflection" point in each segment at which the artifacts are reversed or reflected. By controlling the reflection point and the sign of the aliasing artifacts, these artifacts may be cancelled by overlapping and adding adjacent segments. Additional information on aliasing cancellation may be obtained from U.S. Pat. No. 5,394,473.

(2) Window Functions

In preferred embodiments, the analysis and synthesis window functions are constructed from one or more elementary functions that are derived from basis window functions. Some of the elementary functions are derived from the rectangular-window basis function:

$$\phi(n,p,N)=p \text{ for } 0 \leqq n < N \tag{4}$$

Other elementary functions are derived from another basis window function using a technique described in the following paragraphs. Any function with the appropriate overlap-add properties for TDAC may be used for this basis window function; however, the basis window functions used in a preferred embodiment is the Kaiser-Bessel window function. The first part of this window function may be expressed as:

$$W_{KB}(n, \alpha, v) = \frac{I_0\left[\pi\alpha\sqrt{1-\left(\frac{n-v/2}{v/2}\right)^2}\right]}{I_0[\pi\alpha]} \text{ for } 0 \le n \le v \tag{5}$$

where $\alpha$=Kaiser-Bessel window function alpha factor, n=window sample number, v=segment overlap interval for the derived window function, and $$I_0[x] = \sum_{k=0}^{\infty} \frac{(x/2)^k}{k!}.$$

The last part of this window function is a time-reversed replica of the first v samples of expression 5.

A Kaiser-Bessel-Derived (KBD) window function $W_{KBD}(n,\alpha N)$ is derived from the core Kaiser-Bessel window function $W_{KB}(n,\alpha,v)$. The first part of the KBD window function is derived according to:

$$W_{KBD}(n, \alpha, N) = \sqrt{\frac{\sum_{k=0}^{n} W_{KB}(k, \alpha, v)}{\sum_{k=0}^{v} W_{KB}(k, \alpha, v)}} \text{ for } 0 \le n < \frac{N}{2} \tag{6}$$

The last part of the KBD window function is a time-reversed replica of expression 6.

(a) Analysis Window Functions

Each analysis window function used in this particular embodiment is obtained by concatenating two or more elementary functions shown in Table VI-A.

TABLE VI-A

Elementary Window Functions

| Elementary Function | Function Length | Description |
|---|---|---|
| $E0_{64}(n)$ | 64 | $\phi(n, v = 0, N = 64)$ |
| $E0_{128}(n)$ | 128 | $\phi(n, v = 0, N = 128)$ |
| $E0_{896}(n)$ | 896 | $\phi(n, v = 0, N = 896)$ |
| $E1_{64}(n)$ | 64 | $\phi(n, v = 1.0, N = 64)$ |
| $E1_{640}(n)$ | 640 | $\phi(n, v = 1.0, N = 640)$ |
| $EA_0(n)$ | 64 | $W_{KBD}(n, \alpha = 3.2, N = 128)$ for $0 \leqq n \leqq 64$ |
| $EA_1(n)$ | 128 | $W_{KBD}(n, \alpha = 3.0, N = 256)$ for $0 \leqq n \leqq 128$ |
| $EA_2(n)$ | 256 | $W_{KBD}(n, \alpha = 3.0, N = 512)$ for $0 \leqq n \leqq 256$ |
| $EA_0(-n)$ | 64 | time-reversed replica of $EA_0(n)$ |
| $EA_1(-n)$ | 128 | time-reversed replica of $EA_1(n)$ |
| $EA_2(-n)$ | 256 | time-reversed replica of $EA_2(n)$ |

The analysis window functions for several segment patterns that are used in two different control schemes are constructed from these elementary functions in a manner that is described below.

(b) Synthesis Window Functions

In conventional TDAC systems, identical analysis and synthesis window functions are applied to each segment. In the embodiments described here, identical analysis and synthesis window functions are generally used for each segment but an alternative or "modified" synthesis window function is used for some segments to improve the end-to-end performance of the analysis-synthesis system. In general, alternative or modified synthesis window functions are used for segments at the ends of the "short" and "bridge" segment patterns to obtain an end-to-end frame gain profile for a frame overlap interval equal to 256 samples.

The application of alternative synthesis window functions may be provided by an embodiment of block decoder 70 such as that illustrated in FIG. 6 that applies different synthesis filterbanks to various segments within a frame in response to control signals received from path 67 and optionally path 66. For example, filterbanks 74 and 76 using alternative synthesis window functions may be applied to segments at the ends of the frames, and filterbank 75 with conventional synthesis window functions may be applied to segments that are interior to the frames.

(i) Alter Frequency Response Characteristics

By using alternative synthesis window functions for "end" segments in the frame overlap intervals, a block-decoding process can obtain a desired end-to-end analysis-synthesis system frequency-domain response or time-domain response (gain profile) for the segments at the ends of the frames. The end-to-end response for each segment is essentially equal to the response of the window function formed from the product of the analysis window function and the synthesis window function applied to that segment. This can be represented algebraically as:

$$WP(n)=WA(n)\ WS(n) \tag{7}$$

where WA(n)=analysis window function,

WS(n)=synthesis window function, and

WP(n)=product window function.

If a synthesis window function is modified to convert the end-to-end frequency response to some other desired response, it is modified such that a product of itself and the analysis window function is equal to the product window that has the desired response. If a frequency response corresponding to $WP_D$ is desired and analysis window function WA is used for signal analysis, this relationship can be expressed as:

$$WP_D(n)=WA(n)\ WS_X(n) \tag{8}$$

where $WS_X(n)$=synthesis window function needed to convert the frequency response.

This can be rewritten as:

$$WS_X(n) = \frac{WP_D(n)}{WA(n)} \tag{9}$$

The actual shape of window function $WS_X$ for the end segment in a frame is somewhat more complicated if the frame-overlap interval extends to a neighboring segment that overlaps the end segment. In any case, expression 9 accurately represents what is required of window function $WS_X$ in that portion of the end segment that does not overlap any other segment in the frame. For systems using O-TDAC, that portion is equal to half the segment length, or $0 \leqq n < \frac{1}{2}N$.

If the alpha factor for the KBD product window function $WP_D$ is significantly higher than the alpha factor of the KBD analysis window function WA, the synthesis window function $WS_X$ that is used to modify the end-to-end frequency response must have very large values near the frame boundary. Unfortunately, a synthesis window function with such a shape has very poor frequency response characteristics and will degrade the sound quality of the recovered signal.

This problem may be minimized or avoided by discarding a few samples at the frame boundary where the analysis window function has the smallest values. The discarded samples may be set to zero or otherwise excluded from processing.

Systems that use KBD window functions with lower values of alpha for normal coding will generally require a smaller modification to the synthesis window function and fewer samples to be discarded at the end of the frame.

Additional information about modifying a synthesis window function to alter the end-to-end frequency response and the time-domain gain profile characteristics of an analysis-synthesis system may be obtained from U.S. patent application entitled "Frame-Based Audio Coding With Additional Filterbank to Attenuate Spectral Splatter at Frame Boundaries," Ser. No. 08/953,106 filed Oct. 17, 1997.

The desired product window function $WP_D(n)$ should also provide a desired time-domain response or gain profile. An example of a desired gain profile for the product window is shown in expression 10 and discussed in the following paragraphs.

(ii) Alter the Frame Gain Profile

The use of alternative synthesis window functions also allows a block-decoding process to obtain a desired time-domain gain profile for each frame. An alternative or modified synthesis window function is used for segments in the frame overlap interval when the desired gain profile for a frame differs from the gain profile that would result from using a conventional unmodified synthesis window function.

An "initial" gain profile for a frame, prior to modifying the synthesis window function, may be expressed as $$GP(n, \alpha, x, v) = \begin{cases} 0 & for\ 0 \le n < x \\ W^2_{KBD}(n, \alpha, 2v-4x) & for\ x \le x < v-x \\ 1 & for\ v-x \le n < v \end{cases} \tag{10}$$

where x=number of samples discarded at the frame boundary, and v=frame overlap interval.

(iii) Elementary Functions

Each synthesis window function used in this particular embodiment is obtained by concatenating two or more elementary functions shown in Tables VI-A and VI-B.

TABLE VI-B

Elementary Window Functions

| Elementary Function | Function Length | Description | |
|---|---|---|---|
| $ES_0(n)$ | 192 | $\begin{cases} \frac{GP(n,\ \alpha=3,\ x=0,\ v=256)}{WA_0(n)} \\ GP(n,\ \alpha=3,\ x=0,\ v=256)\cdot WA_0(n) \end{cases}$ | for $0 \leqq n < 64$<br>for $64 \leqq n < 192$ |
| $ES_1(n)$ | 256 | $\begin{cases} GP(n+64,\ \alpha=3,\ x=0,\ v=256)\cdot WA_1(n) \\ WA_1(n) \end{cases}$ | for $0 \leqq n < 192$<br>for $192 \leqq n < 256$ |
| $ES_2(n)$ | 128 | $\begin{cases} GP(n+192,\ \alpha=3,\ x=0,\ v=256)\cdot WA_1(n) \\ WA_1(n) \end{cases}$ | for $0 \leqq n < 64$<br>for $64 \leqq n < 256$ |
| $ES_3(n)$ | 256 | $\begin{cases} \frac{GP(n,\ \alpha=3,\ x=0,\ v=256)}{WA_0(n)} \\ GP(n,\ \alpha=3,\ x=0,\ v=256)\cdot WA_0(n) \end{cases}$ | for $0 \leqq n < 128$<br>for $128 \leqq n < 256$ |

TABLE VI-B-continued

| Elementary Window Functions | | | |
|---|---|---|---|
| Elementary Function | Function Length | Description | |
| $ES_4(n)$ | 128 | $GP(n + 128, \alpha = 3, x = 0, \nu = 256) \cdot WA_0(n)$ | for $0 \leqq n < 128$ |
| $ES_0(-n)$ | 192 | time-reversed replica of $ES_0(n)$ | |
| $ES_1(-n)$ | 256 | time-reversed replica of $ES_1(n)$ | |
| $ES_2(-n)$ | 128 | time-reversed replica of $ES_2(n)$ | |
| $ES_3(-n)$ | 256 | time-reversed replica of $ES_3(n)$ | |
| $ES_4(-n)$ | 128 | time-reversed replica of $ES_4(n)$ | |

The function $WA_0(n)$ shown in Table VI-B is a 256-sample window function formed from a concatenation of three elementary functions $EA_0(n)+EA_1(-n)+E0_{64}(n)$. The function $WA_1(n)$ is a 256-sample window function formed from a concatenation of the elementary functions $EA_1(n)+EA_1(-n)$.

The synthesis window functions for several segment patterns that are used in two different control schemes are constructed from these elementary functions in a manner that is described below.

b. Control Schemes for Block-Encoding

Two schemes for adapting a block-encoding process will now be described. In each scheme, frames of 2048 samples are partitioned into overlapping segments having lengths that vary between a minimum length of 256 samples and an effective maximum length of 1152 samples. In preferred embodiments of systems that process information in frames having a frame rate of about 30 Hz or less, two subframes within each frame are partitioned into overlapping segments of varying length.

Each subframe is partitioned into segments according to one of several patterns of segments. Each pattern specifies a sequence of segments in which each segment is windowed by a particular analysis window function and transformed by a particular analysis transform. The particular analysis window functions and analysis transforms that are applied to various segments in a respective segment pattern are listed in Table VII.

TABLE VII

| Analysis Segment Types | | | | |
|---|---|---|---|---|
| Segment | Analysis Window | Analysis Transform | | |
| Identifier | Function | G | N | $n_0$ |
| A256-A | $EA_0(n) + EA_1(-n) + E0_{64}(n)$ | 1.15 | 256 | 257/2 |
| A256-B | $EA_1(n) + EA_1(-n)$ | 1.00 | 256 | 129/2 |
| A256-C | $E0_{64}(n) + EA_1(n) + EA_0(-n)$ | 1.15 | 256 | 1/2 |
| A384-A | $EA_1(n) + EA_1(-n) + E0_{128}(n)$ | 1.50 | 384 | 385/2 |
| A384-B | $EA_2(n) + EA_1(-n)$ | 1.22 | 384 | 129/2 |
| A384-C | $EA_1(n) + EA_2(-n)$ | 1.22 | 384 | 257/2 |
| A384-D | $E0_{128}(n) + EA_1(n) + EA_1(-n)$ | 1.50 | 384 | 1/2 |
| A512-A | $EA_2(n) + E1_{64}(n) + EA_1(-n) + E0_{64}(n)$ | 1.22 | 512 | 257/2 |
| A512-B | $E0_{64}(n) + EA_1(n) + E1_{64}(n) + EA_2(-n)$ | 1.41 | 512 | 257/2 |
| A2048-A | $EA_2(n) + E1_{640}(n) + EA_2(-n) + E0_{896}(n)$ | 3.02 | 2048 | 2049/2 |
| A2048-B | $E0_{896}(n) + EA_2(n) + E1_{640}(n) + EA_2(-n)$ | 3.02 | 2048 | 1/2 |

Each table entry describes a respective segment type by specifying the analysis window function to be applied to a segment of samples and the analysis transform to be applied to the windowed segments of samples. The analysis window functions shown in the table are described in terms of a concatenation of elementary window functions discussed above. The analysis transforms are described in terms of the parameters G, N and $n_0$ discussed above.

(1) First Scheme

In the first scheme, the segment in each pattern are constrained to have a length equal to an integer power of two. This constraint reduces the processing resources required to implement the analysis and synthesis transforms.

The short-1 pattern comprises eight segments in which the first segment is a A256-A type segment and the following seven segments are A256-B type segments. The short-2 pattern comprises eight segments in which the first seven segments are A256-B type segments and the last segment is a A256-C type segment.

The bridge-1 pattern comprises seven segments in which the first segment is a A256-A type segment, the interim five segments are A256B type segments, and the last segment is a A512-A type segment. The bridge-2 pattern comprises seven segments in which the first segment is a A512-B type segment, the interim five segments are A256B type segments, and the last segment is a A256-C type segment.

The long-1 pattern comprises a single A2048-A type segment. Although this segment is actually 2048 samples long, its effective length in terms of temporal resolution is only 1152 samples because only 1152 points of the analysis window function are non-zero. The long-2 pattern comprises a single A2048-B type segment. The effective length of this segment is 1152.

Each of these segment patterns is summarized in Table VII-A.

TABLE VIII-A

Analysis Segment Patterns for First Control Scheme

| Segment Pattern | Sequence of Segment Types | | | | | | | |
|---|---|---|---|---|---|---|---|---|
| Short-1 | A256-A | A256-B | A256-B | A256-B | A256-B | A256-B | A256-B | A256-B |
| Short-2 | A256-B | A256-B | A256-B | A256-B | A256-B | A256-B | A256-B | A256-C |
| Bridge-1 | A256-A | A256-B | A256-B | A256-B | A256-B | A256-B | A512-A | |
| Bridge-2 | A512-B | A256-B | A256-B | A256-B | A256-B | A256-B | A256-C | |
| Long-1 | A2048-A | | | | | | | |
| Long-2 | A2048-B | | | | | | | |

Figure 12:
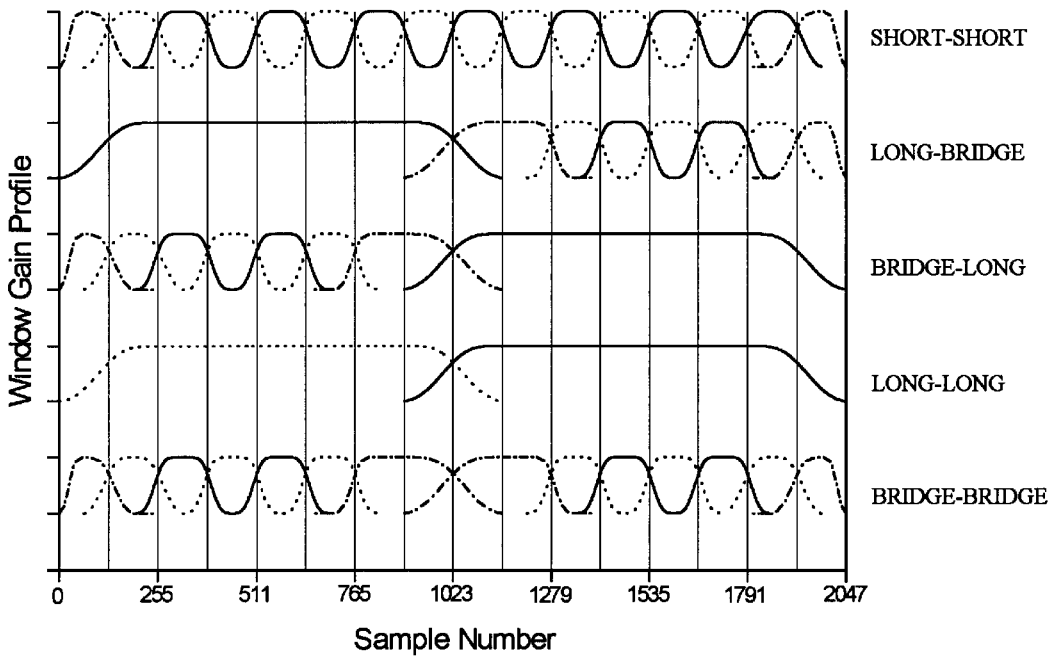
FIGS. 12 through 15 illustrate the gain profiles of analysis and synthesis window functions for several patterns of segments according to two control schemes.

Various combinations of the segment patterns that may be specified by control 46 according to the first control scheme are illustrated in FIG. 12. The row with the label "short-short" illustrates the gain profiles of the analysis window functions for the short-1 to short-2 combination of segment patterns. The other rows in the figure illustrate the gain profiles of the analysis window functions for various combinations of the bridge and long segment patterns.

(2) Second Scheme

In the second scheme, a few segments in some of the patterns have a length equal to 384, which is not an integer powers of two. The use of this segment length incurs an additional cost but offers an advantage as compared to the first control scheme. The additional cost arises from the additional processing resources required to implement a transform for a 384-sample segment. The additional cost can be reduced by dividing each 384-sample segment into three 128-sample subsegments, combining pairs of samples in each segment to generate 32 complex values, applying a complex Fast Fourier Transform (FFT) to each segment of complex-valued samples, and combining the results to obtain the desired transform coefficients. Additional information about this processing technique may be obtained from U.S. Pat. No. 5,394,473, U.S. Pat. No. 5,297,236, U.S. patent application Ser. No. 08/821,017 filed Mar. 19, 1997, and Oppenheim and Schafer, "Digital Signal Processing," Englewood Cliffs, N.J.: Prentice-Hall, Inc., 1975, pp.307–314. The advantages realized from using 384-sample blocks arise from allowing the use of window functions that have better frequency response characteristics, and from reducing processing delays.

The short-1 pattern comprises eight segments in which the first segment is a A384-A type segment and the following seven segments are A256-B type segments. The effective length of the A384-A type segment is 256. The short-2 pattern comprises seven segments in which the first six segments are A256-B type segments and the last segment is a A384-D type segment. The effective length of the A384-D type segment is 256. Unlike other combinations of segment patterns, the lengths of the two subframes for this combination of patterns are not equal.

The bridge-1 pattern comprises seven segments in which the first segment is a A384-A type segment, the five interim segments are A256B type segments, and the last segment is a A384-C type segment. The bridge-2 pattern comprises seven segments in which the first segment is a A384-B type segment, the five interim segments are A256B type segments, and the segment is a A384-D type segment.

The long-1 pattern comprises a single A2048-A type segment. The effective length of this segment is 1152. The long-2 pattern comprises a single a A2048-B type segment. The effective length of this segment is 1152.

Each of these segment patterns is summarized in Table VIII-B.

TABLE VIII-B

Analysis Segment Patterns for Second Control Scheme

| Segment Pattern | Sequence of Segment Types | | | | | | | |
|---|---|---|---|---|---|---|---|---|
| Short-1 | A384-A | A256-B | A256-B | A256-B | A256-B | A256-B | A256-B | A256-B |
| Short-2 | A256-B | A256-B | A256-B | A256-B | A256-B | A256-B | A384-D | |
| Bridge-1 | A384-A | A256-B | A256-B | A256-B | A256-B | A256-B | A384-C | |
| Bridge-2 | A384-B | A256-B | A256-B | A256-B | A256-B | A256-B | A384-D | |
| Long-1 | A2048-A | | | | | | | |
| Long-2 | A2048-B | | | | | | | |

Figure 13:
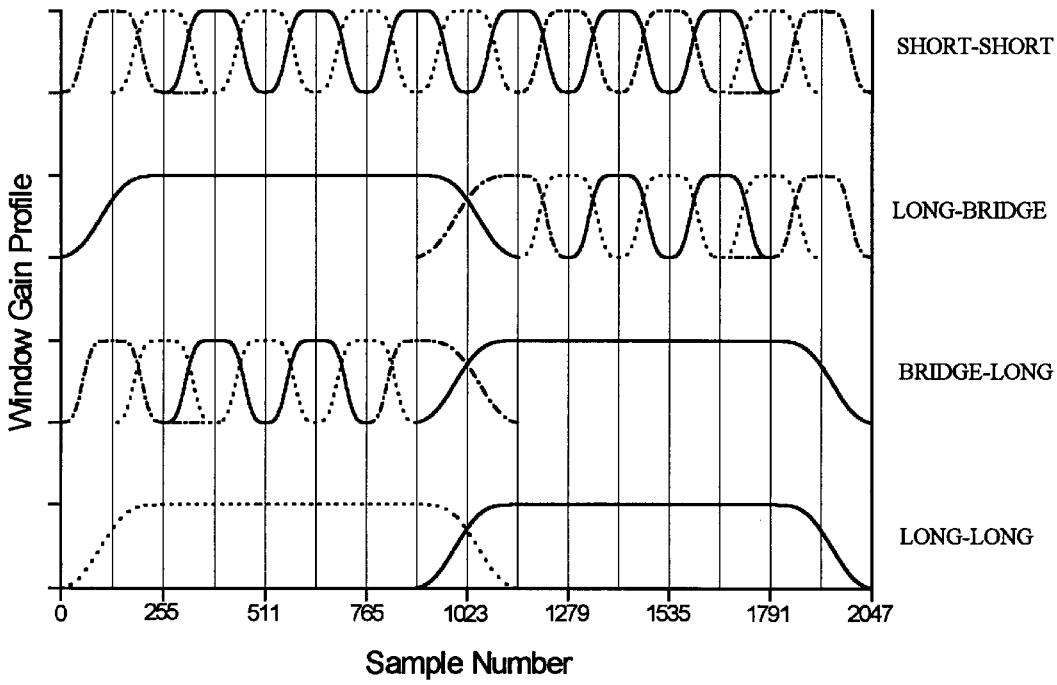

Various combinations of the segment patterns that may be specified by control 46 according to the second control scheme are illustrated in FIG. 13. The row with the label "short-short" illustrates the gain profiles of the analysis window functions for the short-1 to short-2 combination of segment patterns. The other rows in the figure illustrate the gain profiles of the analysis window functions for various combinations of the bridge and long segment patterns. The bridge-1 to bridge-2 combination is not shown but is a valid combination for this control scheme.

c. Control Schemes for Block-Decoding

Two schemes for adapting a block-decoding process will now be described. In each scheme, frames of encoded information are decoded to generate frames of 2048 samples that are partitioned into overlapping segments having lengths that vary between a minimum length of 256 samples and an effective maximum length of 1152 samples. In preferred embodiments of systems that process information in frames having a frame rate of about 30 Hz or less, two subframes within each frame are partitioned into overlapping segments of varying length.

Each subframe is partitioned into segments according to one of several patterns of segments. Each pattern specifies a sequence of segments in which each segment is generated by a particular synthesis transform and the results of the transformation are windowed by a particular synthesis window function. The particular synthesis transforms and synthesis window functions are listed in Table IX.

TABLE IX

Synthesis Segment Types

| Segment Identifier | Synthesis Window Function | Synthesis Transform N | Synthesis Transform $n_0$ |
|---|---|---|---|
| S256-A | $ES_0(n) + E0_{64}(n)$ | 256 | 257/2 |
| S256-B | $EA_1(n) + EA_1(-n)$ | 256 | 129/2 |
| S256-C | $E0_{64}(n) + ES_0(-n)$ | 256 | 1/2 |
| S256-D1 | $ES_1(n)$ | 256 | 129/2 |
| S256-D2 | $ES_1(-n)$ | 256 | 129/2 |
| S256-D3 | $ES_2(n) + EA_1(-n)$ | 256 | 129/2 |
| S256-D4 | $EA_1(n) + ES_2(-n)$ | 256 | 129/2 |
| S256-E1 | $ES_4(n)$ | 256 | 129/2 |
| S256-E2 | $ES_4(-n)$ | 256 | 129/2 |
| S384-A | $ES_3(n) + E0_{128}(n)$ | 384 | 385/2 |
| S384-B | $EA_2(n) + EA_1(-n)$ | 384 | 129/2 |
| S384-C | $EA_1(n) + EA_2(-n)$ | 384 | 257/2 |
| S384-D | $E0_{128}(n) + ES_3(-n)$ | 384 | 1/2 |
| S512-A | $EA2(n) + E1_{64}(n) + EA_1(-n) + E0_{64}(n)$ | 512 | 257/2 |
| S512-B | $E0_{64}(n) + EA_1(n) + E1_{64}(n) + EA_2(-n)$ | 512 | 257/2 |
| S2048-A | $EA_2(n) + E1_{640}(n) + EA_2(-n) + E0_{896}(n)$ | 2048 | 2049/2 |
| S2048-B | $E0_{896}(n) + EA_2(n) + E1_{640}(n) + EA_2(-n)$ | 2048 | 1/2 |

Each table entry describes a respective segment type by specifying the synthesis transform to be applied to a block of encoded information to generate a segment of samples, and the synthesis window function to be applied to the resulting segment to generate a windowed segment of samples. The synthesis transforms are described in terms of the parameters N and $n_0$ discussed above. The synthesis window functions shown in the table are described in terms of a concatenation of elementary window functions discussed above. Some of the synthesis window functions used during the decoding process are modified forms of the functions listed in the table. These modified or alternative window functions are used to improve end-to-end system performance.

(1) First Scheme

In the first scheme, the segment lengths in each pattern are constrained to be an integer power of two. This constraint reduces the processing resources required to implement the analysis and synthesis transforms.

The short-1 pattern comprises eight segments in which the first segment is a S256-A type segment, the second segment is a S256-D1 type segment, the third segment is a S256-D3 type segment, and the following five segments are S256B type segments. The short-2 pattern comprises eight segments in which the first five segments are S256-B type segments, the sixth segment is a S256-D4 type segment, the seventh segment is a S256-D2 type segment, and the last segment is a S256-C type segment.

The shape of the analysis and synthesis window functions and the parameters N and $n_0$ for the analysis and synthesis transforms for the first segment in the short-1 pattern are designed so that the audio information for this first segment can be recovered independently of other segments without aliasing artifacts in the first 64 samples of the segment. This allows a frame of information that is divided into segments according to the short-1 pattern to be appended to any arbitrary stream of information without concern for aliasing cancellation.

The analysis and synthesis window functions and the analysis and synthesis transforms for the last segment in the short-2 pattern are designed so that the audio information for this last segment can be recovered independently of other segments without aliasing artifacts in the last 64 samples of the segment. This allows a frame of information that is divided into segments according to the short-2 pattern to be followed by any arbitrary stream of information without concern for aliasing cancellation.

Various considerations for the design of the window function and transform are discussed in more detail in U.S. patent application entitled "Frame-Based Audio Coding With Additional Filterbank to Suppress Aliasing Artifacts at Frame Boundaries," Ser. No. 08/953,121 filed Oct. 17, 1997.

The bridge-1 pattern comprises seven segments in which the first segment is a S256-A type segment, the second segment is a S256-D1 type segment, the third segment is a S256-D3 type segment, the next three segments are S256B type segments, and the last segment is a S512-A type segment. The bridge-2 pattern comprises seven segments in which the first segment is a S512-B type segment, the next three segments are S256B type segments, the fifth segment is a S256-D4 type segment, the sixth segment is a S256-D2 type segment, and the last segment is a S256-C type segment.

The first segment in the bridge-1 pattern and the last segment in the bridge-2 pattern can be recovered independently of other segments without aliasing artifacts in the first and last 64 samples, respectively. This allows a bridge-1 pattern of segments to follow any arbitrary stream of information without concern for aliasing cancellation and it allows a bridge-2 pattern of segments to be followed by any arbitrary stream of information without concern for aliasing cancellation.

The long-1 pattern comprises a single S2048-A type segment. Although this segment is actually 2048 samples long, its effective length in terms of temporal resolution is only 1152 samples because only 1152 points of the synthesis window function are non-zero. The long-2 pattern comprises a single S2048-B type segment. The effective length of this segment is 1152.

The segments in the long-1 and long-2 patterns can be recovered independently of other segments without aliasing artifacts in the first and last 256 samples, respectively. This allows a long-1 pattern of segments to follow any arbitrary stream of information without concern for aliasing cancellation and it allows a long-2 pattern of segments to be followed by any arbitrary stream of information without concern for aliasing cancellation.

Each of these segment patterns is summarized in Table X-A.

TABLE X-A

Synthesis Segment Patterns for First Control Scheme

| Segment Pattern | Sequence of Segment Types | | | | | | | |
|---|---|---|---|---|---|---|---|---|
| Short-1 | A256-A | A256-D1 | A256-D3 | A256-B | A256-B | A256-B | A256-B | A256-B |
| Short-2 | A256-B | A256-B | A256-B | A256-B | A256-B | A256-D4 | A256-D2 | A256-C |
| Bridge-1 | A256-A | A256-D1 | A256-D3 | A256-B | A256-B | A256-B | A512-A | |
| Bridge-2 | A512-B | A256-B | A256-B | A256-B | A256-D4 | A256-D2 | A256-C | |
| Long-1 | A2048-A | | | | | | | |
| Long-2 | A2048-B | | | | | | | |

Figure 14:
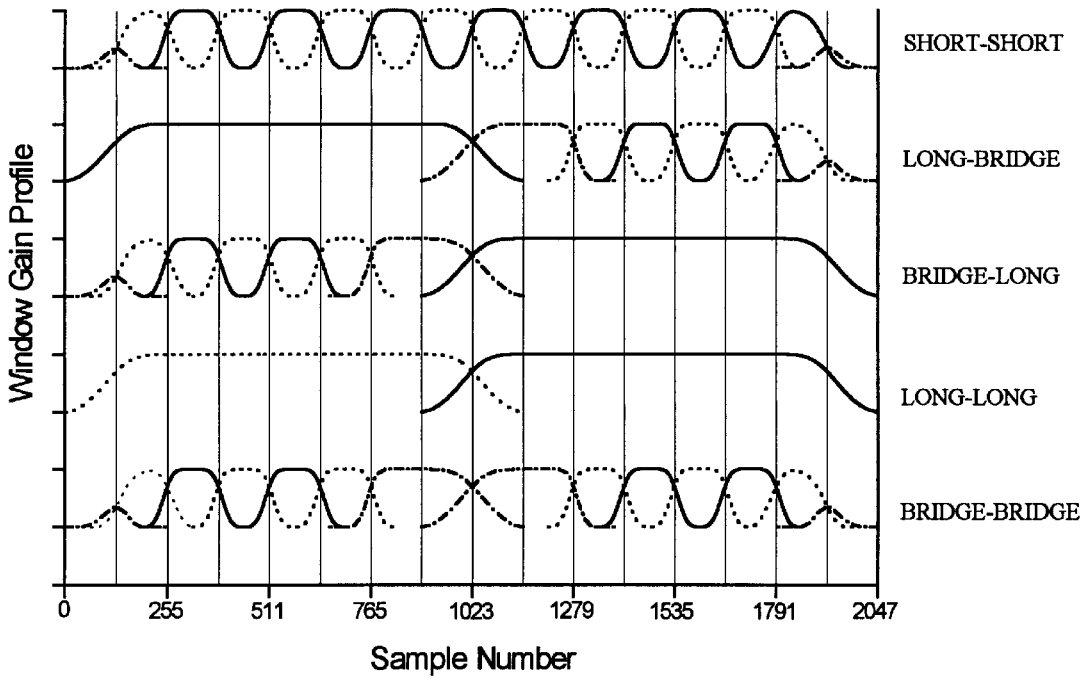

Various combinations of the segment patterns that may be specified by control 65 according to the first control scheme are illustrated in FIG. 14. The row with the label "short-short" illustrates the gain profiles of the synthesis window functions for the short-1 to short-2 combination of segment patterns. The other rows in the figure illustrate the gain profiles of the synthesis window functions for various combinations of the bridge and long segment patterns.

(2) Second Scheme

In the second scheme, some of the segments have a length equal to 384, which is not an integer powers of two. Advantages and disadvantages of this scheme are discussed above.

The short-1 pattern comprises eight segments in which the first segment is a S384-A type segment, the second segment is a S256-E1 type segment, and the following six segments are S256-B type segments. The short-2 pattern comprises seven segments in which the first five segments are S256-B type segments, the sixth segment is a S256-E2 type segment, and the last segment is a S384-D type segment. Unlike other combinations of segment patterns, the lengths of the two subframes for this combination of patterns are not equal.

The first segment in the short-1 pattern and the last segment in the short-2 pattern can be recovered independently of other segments without aliasing artifacts in the first and last 128 samples, respectively. This allows a frame that is partitioned into segments according to the short-1 and short-2 patterns to follow or to be followed by any arbitrary stream of information without concern for aliasing cancellation.

The bridge-1 pattern comprises seven segments in which the first segment is a S384-A type segment, the five interim segments are S256B type segments, and the last segment is a S384-C type segment. The bridge-2 pattern comprises seven segments in which the first segment is a S384-B type segment, the five interim segments are S256B type segments, and the last segment is a S384-D type segment. The effective lengths of the S384-A, S384-B, S384-C and S384-D type segments are 256.

The first segment in the bridge-1 pattern and the last segment in the bridge-2 pattern can be recovered independently of other segments without aliasing artifacts in the first and last 128 samples, respectively. This allows a bridge-1 pattern of segments to follow any arbitrary stream of information without concern for aliasing cancellation and it allows a bridge-2 pattern of segments to be followed by any arbitrary stream of information without concern for aliasing cancellation.

The long-1 pattern comprises a single S2048-A type segment. The effective length of this segment is 1152. The long-2 pattern comprises a single S2048-B type segment. The effective length of this segment is 1152. The long-1 and long-2 patterns for the second control scheme are identical to the long-1 and long-2 patterns for the first control scheme.

Each of these segment patterns is summarized in Table X-B.

TABLE X-B

Synthesis Segment Patterns for Second Control Scheme

| Segment Pattern | Sequence of Segment Types | | | | | | | |
|---|---|---|---|---|---|---|---|---|
| Short-1 | S384-A | A256-E1 | A256-B | A256-B | A256-B | A256-B | A256-B | A256-B |
| Short-2 | A256-B | A256-B | A256-B | A256-B | A256-B | A256-E2 | A384-D | |
| Bridge-1 | A384-A | A256-B | A256-B | A256-B | A256-B | A256-B | A384-C | |
| Bridge-2 | A384-B | A256-B | A256-B | A256-B | A256-B | A256-B | A384-D | |
| Long-1 | A2048-A | | | | | | | |
| Long-2 | A2048-B | | | | | | | |

Figure 15:
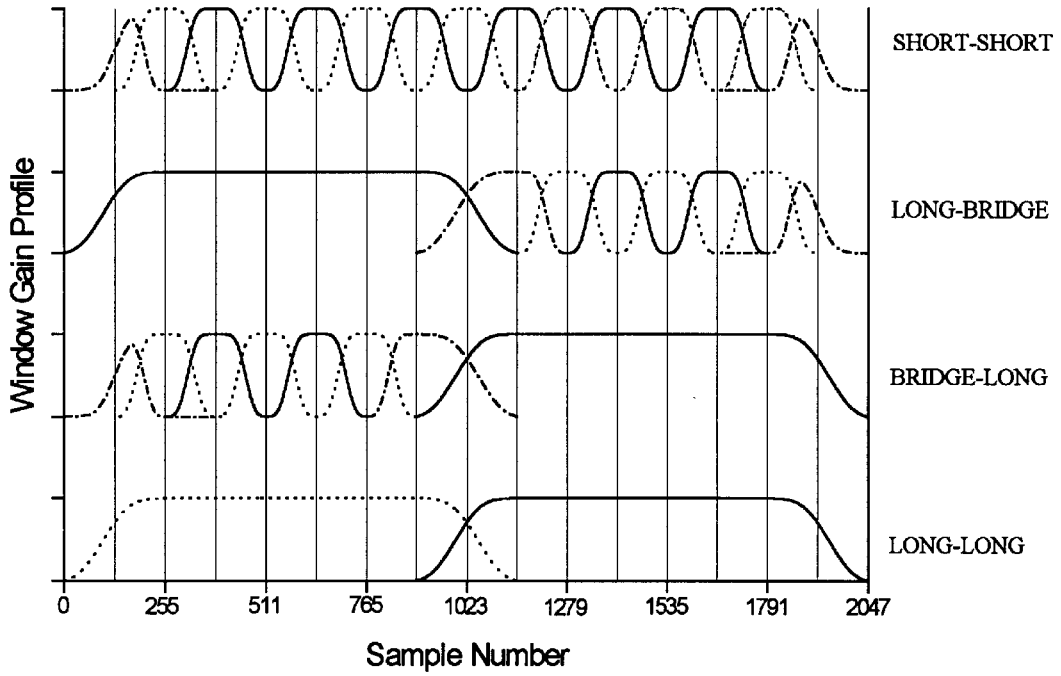

Various combinations of the segment patterns that may be specified by control 65 according to the second control scheme are illustrated in FIG. 15. The row with the label "short-short" illustrates the gain profiles of the synthesis window functions for the short-1 to short-2 combination of segment patterns. The other rows in the figure illustrate the gain profiles of the synthesis window functions for various combinations of the bridge and long segment patterns. The bridge-1 to bridge-2 combination is not shown but is a valid combination for this control scheme.

4. Frame Formatting

Frame 48 may assemble encoded information into frames according to a wide variety of formats. Two alternative formats are described here. According to these two formats, each frame conveys encoded information for concurrent segments of one or more audio channels that can be decoded independently of other frames. Preferably the information in each frame is conveyed by one or more fixed bit-length digital "words" that are arranged in sections. Preferably, the word length used for a particular frame can be determined from the contents of the frame so that a decoder can adapt its processing to this length. If the encoded information stream is subject to transmission or storage errors, an error detection code like a cyclical redundancy check (CRC) code or a Fletcher's checksum may be included in each frame section and/or provided for the entire frame.

a. First Format

Figure 16A:
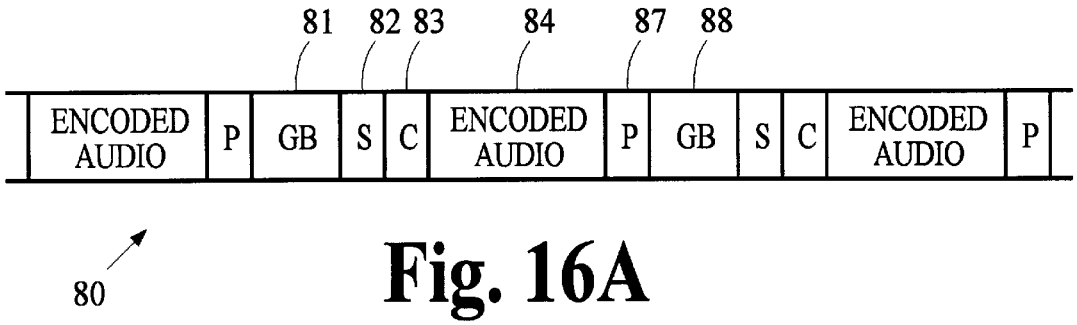
FIGS. 16A through 16C illustrate an assembly of control information and encoded audio information according to a first frame format.

The first frame format is illustrated in FIG. 16A. As shown in the figure, encoded information stream 80 comprises frames with information assembled according to a first format. Adjacent frames are separated by gaps or guard bands that provide an interval in which edits or cuts can be made without causing a loss of information. For example, as shown in the figure, a particular frame is separated from adjacent frames by guard bands 81 and 88.

According to the first format, frame section 82 conveys a synchronization word having a distinctive data pattern that signal processing equipment can use to synchronize operation with the contents of the information stream. Frame section 83 conveys control information that pertains to the encoded audio information conveyed in frame section 84, but is not part of the encoded audio information itself Frame section 84 conveys encoded audio information for one or more audio channels. Frame section 87 may be used to pad the frame to a desired total length. Alternatively, frame section 87 may be used to convey information instead of or in addition to frame padding. This information may convey characteristics of the audio signal that is represented by the encoded audio information such as, for example, analog meter readings that are difficult to derive from the encoded digital audio information.

Figure 16B:
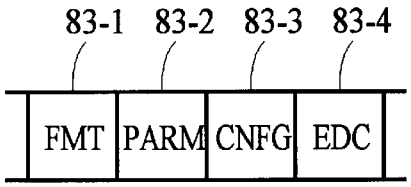

Referring to FIG. 16B, frame section 83 conveys control information that is arranged in several subsections. Subsection 83-1 conveys an identifier for the frame and an indication of the frame format. The frame identifier may be an 8-bit number having a value that increases by one for each succeeding frame, wrapping around from the value 256 to the value 0. The indication of frame format identifies the location and extent of the information conveyed in the frame. Subsection 83-2 conveys one or more parameters needed to properly decode the encoded audio information in frame section 84. Subsection 83-3 conveys the number of audio channels and the program configuration of these channels that is represented by the encoded audio information in frame section 84. This program configuration may indicate, for example, one or more monaural programs, one or more two-channel programs, or a program with three-channel left-center-right and two-channel surround. Subsection 84-4 conveys a CRC code or other error-detection code for frame section 83.

Figure 16C:
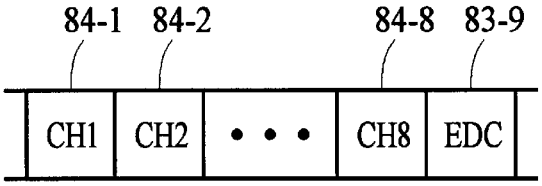

Referring to FIG. 16C, frame section 84 conveys encoded audio information arranged in one or more subsections that each convey encoded information representing concurrent segments of respective audio channels, up to a maximum of eight channels. In subsections 84-1, 84-2 and 84-8, for example, frame section 84 conveys encoded audio information representing concurrent segments of audio for channel numbers 1, 2 and 8, respectively. Subsection 84-9 conveys a CRC code or other error detection code for frame section 84.

b. Second Format

Figure 17A:
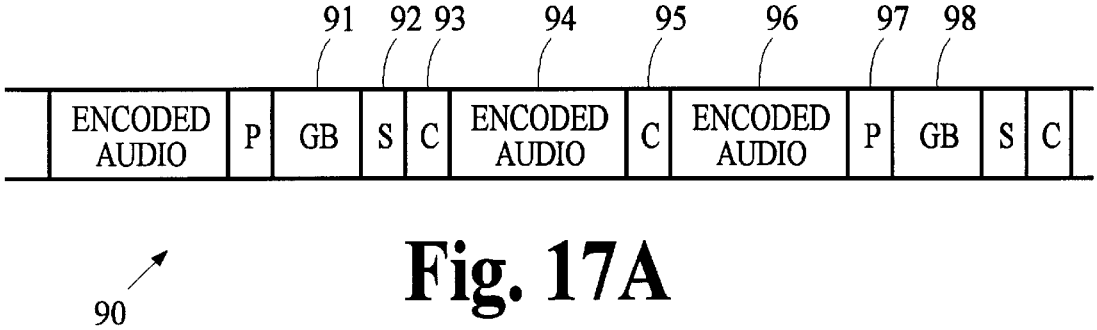
FIGS. 17A through 17C illustrate an assembly of control information and encoded audio information according to a second frame format.

The second frame format is illustrated in FIG. 17A. This second format is similar to the first format but is preferred over the first format in video/audio applications having a video frame rate of about 30 Hz or less. Adjacent frames are separated by gaps or guard bands such as guard bands 91 and 98 that provide an interval in which edits or cuts can be made without causing a loss of information.

According to the second format, frame section 92 conveys a synchronization word. Frame sections 93 and 94 convey control information and encoded audio information similar to that described above for frame sections 83 and 84, respectively, in the first format. Frame section 87 may be used to pad the frame to a desired total length and/or to convey information such as, for example, analog meter readings.

The second format differs from the first format in that audio information is partitioned into two subframes. Frame section 94 conveys the first subframe of encoded audio information representing the first part of a frame of concurrent segments for one or more audio channels. Frame section 96 conveys the second subframe of encoded audio information representing the second part of the frame of concurrent segments. By partitioning the audio information into two subframes, delays incurred in the block-decoding process may be reduced, as explained below.

Figure 17B:
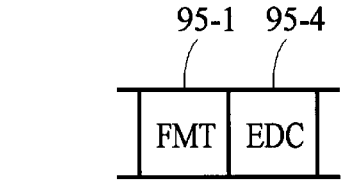

Referring to FIG. 17B, frame section 95 conveys additional control information that pertains to the encoded information conveyed in frame section 96. Subsection 95-1 conveys an indication of the frame format. Subsection 94-4 conveys a CRC code or other error-detection code for frame section 95.

Figure 17C:
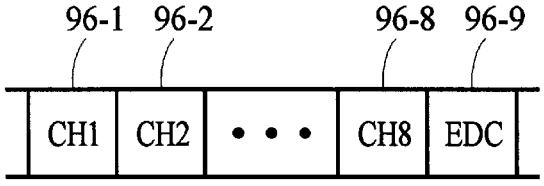

Referring to FIG. 17C, frame section 96 conveys the second subframe of encoded audio information that is arranged in one or more subsections that each convey encoded information for a respective audio channel. In subsections 96-1, 96-2 and 96-8, for example, frame section 96 conveys encoded audio information representing the second subframe for audio channel numbers 1, 2 and 8, respectively. Subsection 96-9 conveys a CRC code or other error detection code for frame section 96.

c. Additional Features

It may be desirable in some encoding/decoding systems to prevent certain data patterns from occurring in the encoded information conveyed by a frame. For example, the synchronization word mentioned above has a distinctive data pattern that should not occur in anywhere else in a frame. If this distinctive data pattern did occur elsewhere, such an occurrence could be falsely identified as a valid synchronization word, causing equipment to lose synchronization with the information stream. As another example, some audio equipment that process 16-bit PCM data words reserve the data value −32768 (expressed in hexadecimal notation as 0×8000) to convey control or signaling information; therefore, it is desirable in some systems to avoid the occurrence of this value as well. Several techniques for avoiding "reserved" or "forbidden" data patterns are disclosed in U.S. patent application Ser. No. 09/175,090 entitled "Avoiding Forbidden Data Patterns in Coded Audio Data," filed Oct. 19, 1998, which is incorporated herein by reference. These techniques modify or encode information to avoid any special data patterns and pass with the encoded information a key or other control information that can be used to recover the original information by reversing the modifications or encoding. In preferred embodiments, the key or control information that pertains to information in a particular frame section is conveyed in that respective frame section or, alternatively, one key or control information that pertains to the entire frame is conveyed somewhere in the respective frame.

5. Splice Detection

The two control schemes discussed above adapt signal analysis and signal synthesis processes to improve overall system performance for encoding and decoding audio signals that are substantially stationary at times and are highly non-stationary at other times. In preferred embodiments, however, additional features may provide further improvements for coding audio information that is subject to editing operations like splicing.

As explained above, a splice generally creates a discontinuity in a stream of audio information that may or may not be perceptible. If conventional TDAC analysis-synthesis processes are used, aliasing artifacts on either side of a splice almost certainly will not be cancelled. Both control schemes discussed above avoid this problem by recovering individual frames of audio information that are free of aliasing artifacts. As a result, frames of audio information that are encoded and decoded according to either control scheme may be spliced and joined with one another without concern for aliasing cancellation.

Furthermore, by using alternative or modified synthesis window functions for end segments within the "short" and "bridge" segment patterns described above, either control scheme is able to recover sequences of segment frames having gain profiles that overlap and add within 256-sample frame overlap intervals to obtain a substantially constant time-domain gain. Consequently, the frame gain profiles in the frame overlap intervals is correct for arbitrary pairs of frames across a splice.

The features discussed thus far are substantially optimized for perceptual coding processes by implementing filterbanks having frequency response characteristics with increased attenuation in the filter stopbands in exchange for a broader filter passband. Unfortunately, splice edits tend to generate significant spectral artifacts or "spectral splatter" within a range of frequencies that is not within what is normally regarded as the filter stopband. Hence, the filterbanks that are implemented by the features discussed above are designed to optimize general perceptual coding performance but do not provide enough attenuation to render inaudible these spectral artifacts created at splice edits.

System performance may be improved by detecting the occurrence of a splice and, in response, adapting the frequency response of the synthesis filterbank to attenuate this spectral splatter. One way in which this may be done is discussed below. Additional information may be obtained from U.S. patent application entitled "Frame-Based Audio Coding With Additional Filterbank to Attenuate Spectral Splatter at Frame Boundaries," Ser. No. 08/953,106 filed Oct. 17, 1997.

Referring to FIG. 4, control 65 may detect a splice by examining some control information or "frame identifier" that is obtained from each frame received from path 61. For example, encoder 40 may provide a frame identifier by incrementing a number or by generating an indication of time and date for each successive frame and assembling this identifier into the respective frame. When control 65 detects a discontinuity in a sequence of frame identifiers obtained from a stream of frames, a splice-detect signal is generated along path 66. In response to the splice-detect signal received from path 66, decode 70 may adapt the frequency response of a synthesis filterbank or may select an alternative filterbank having the desired frequency response to process one or more segments on either side of the boundary between frames where a splice is deemed to occur.

In a preferred embodiment, the desired frequency response for frames on either side of a detected splices is obtained by applying a splice-window process. This may be accomplished by applying a frame splice-window function to an entire frame of segments as obtained from the control schemes described above, or it may be accomplished within the control schemes by applying segment splice-window functions to each segment obtained from the synthesis transform. In principle, these two processes are equivalent.

A segment splice-window function for a respective segment may be obtained by multiplying the normal synthesis window function for that respective segment, shown in Table IX, by a portion of a frame splice-window function that is aligned with the respective segment. The frame splice-window functions are obtained by concatenating two or more elementary functions shown in Table VI-C.

TABLE VI-C

Elementary Window Functions

| Elementary Function | Function Length | Description |
|---|---|---|
| $E1_{1536}(n)$ | 1536 | $\phi(n, \nu = 1.0, N = 1536)$ |
| $E1_{1792}(n)$ | 1792 | $\phi(n, \nu = 1.0, N = 1792)$ |
| $ES_5(n)$ | 256 | $\frac{GP(n,\ \alpha = 1,\ = 16,\ \nu = 256)}{GP(n,\ \alpha = 3,\ x = 0,\ \nu = 256)}\ for\ 0 \leqq n < 256$ |
| $ES_5(-n)$ | 256 | time-reversed replica of $ES_5(n)$ |

The frame splice-window functions for three types of frames are listed in Table XI.

TABLE XI

Frame Splice-Window Functions

| Synthesis Window Function | Frame Type |
|---|---|
| $ES_5(n) + E1_{1792}(n)$ | Splice at start of frame |
| $E1_{1792}(n) + ES_5(-n)$ | Splice at end of frame |
| $ES_5(n) + E1_{1536}(n) + ES_5(-n)$ | Splices at both frame boundaries |

By using the frame splice-window functions listed above, the splice-window process essentially changes the end-to-end analysis-synthesis window functions for the segments in the frame overlap interval from KBD window functions with an alpha value of 3 into KBD window functions with an alpha value of 1. This change decreases the width of the filter passband in exchange for decreasing the level of attenuation in the stopband, thereby obtaining a frequency response that more effectively suppresses audible spectral splatter.

6. Signal Conversion

The embodiments of audio encoders and decoders discussed above may be incorporated into applications that process audio information having essentially any format and sample rate. For example, an audio sample rate of 48 kHz is normally used in professional equipment and a sample rate of 44.1 kHz is normally used in consumer equipment. Furthermore, the embodiments discussed above may be incorporated into applications that process video information in frame formats and frame rates conforming to a broad range of standards. Preferably, for applications in which the video frame rate is about 30 Hz or less, audio information is processed according to the second format described above.

The implementation of practical devices can be simplified by converting audio information into an internal audio sample rate so that the audio information can be encoded into a common structure independent of the external audio sample rate or the video frame rate.

Referring to FIGS. 3 and 4, convert 43 is used to convert audio information into a suitable internal sample rate and convert 68 is used to convert the audio information from the internal sample rate into the desired external audio sample rate. The conversions is carried out so that the internal audio sample rate is an integer multiple of the video frame rate. Examples of suitable internal sample rates for several video frame rates are shown in Table XII. The conversion allows the same number of audio samples to be encoded and conveyed with a video frame.

TABLE XII

Internal Sample Rates

| Video Standard | Video Frame Rate (Hz) | Audio Samples per Frame | Internal Sample Rate (kHz) |
|---|---|---|---|
| DTV | 30 | 2048 | 53.76 |
| NTSC | 29.97 | 2048 | 53.706 |
| PAL | 25 | 2048 | 44.8 |
| Film | 24 | 2048 | 43.008 |
| DTV | 23.976+ | 2048 | 42.96 |

The internal sample rates shown in the table for NTSC (29.97 Hz) and DTV (23.976 Hz) are only approximate. The rates for these two video standards are equal to 53,760,000/1001 and 43,008,000/1001, respectively.

Essentially any technique for sample rate conversion may be used. Various considerations and implementations for sample rate conversion are disclosed in Adams and Kwan, "Theory and VLSI Architectures for Asynchronous Sample Rate Converters," J. of Audio Engr. Soc., July 1993, vol. 41, no. 7/8, pp. 539–555.

If sample rate conversion is used, the filter coefficients for HPF 101 in the transient detector described above for analyze 45 may need to be modified to keep a constant cutoff frequency. The benefit of this feature can be determined empirically.

D. Processing Delays

The processes carried out by block encoder 50 and block decoder 70 have delays that are incurred to receive and buffer segments and blocks of information. Furthermore, the two schemes for controlling the block-encoding process described above incur an additional delay that is required to receive and buffer the blocks of audio samples that are analyzed by analyze 45 for segment length control.

When the second format is used, the first control scheme must receive and buffer 1344 audio samples or twenty-one 64-sample blocks of audio information before the first step S461 in the segment-length control method illustrated in FIG. 10 can begin. The second control scheme incurs a slightly lower delay, needing to receive and buffer only 1280 audio samples or twenty 64-sample blocks of audio information.

If encoder 40 is to carry out its processing in real time, it must complete the block-encoding process in the time remaining for each frame after the first part of that frame has been received, buffered and analyzed for segment length control. Since the first control scheme incurs a longer delay to begin analyzing the blocks, it requires encode 50 to complete its processing in less time than is required by the second control scheme.

In preferred embodiments, the total processing delay incurred by encoder 40 is adjusted to equal the interval between adjacent video frames. A component may be included in encoder 40 to provide additional delay if necessary. If a total delay of one frame interval is not possible, the total delay may be adjusted to equal an integer multiple of the video-frame interval.

Both control schemes impose substantially equal computational requirements on decode 60. The maximum delay incurred in decode 60 is difficult to state in general terms because it depends on a number of factors such as the precise encoded frame format and the number of bits that are used to convey encoded audio information and control information.

When the first format is used, an entire frame must be received and buffered before the segment-control method may begin. Because the encoding and signal sample-rate conversion processes cannot be carried out instantaneously, a one-frame delay for encoder 40 is not possible. In this case, a total delay of two frame rates is preferred. A similar limitation applies to decoder 60.

What is claimed is:

1. A method for audio encoding that comprises steps performing the acts of:

receiving a reference signal conveying alignment of video information frames in a sequence of video information frames in which adjacent frames are separated by a frame interval;

receiving an audio signal conveying audio information;

analyzing the audio signal to identify characteristics of the audio information;

generating a control signal in response to the characteristics of the audio information, wherein the control signal conveys segment lengths for segments of the audio information in a sequence of overlapping segments, a respective segment having a respective overlap interval with an adjacent segment and the sequence having a length equal to the frame interval plus a frame overlap interval;

applying an adaptive block encoding process to the overlapping segments in the sequence to generate a plurality of blocks of encoded information, wherein the block encoding process adapts in response to the control signal; and assembling the plurality of blocks of encoded information and control information conveying the segment lengths to form an encoded information frame that is aligned with the reference signal.

2. A method for audio encoding according to claim 1 wherein the block encoding process applies a bank of bandpass filters or a transform to the segments of the audio information to generate blocks of subband signals or transform coefficients, respectively.

3. A method for audio encoding according to claim 1 wherein the block encoding process applies a respective analysis window function to each segment of the audio information to generate windowed segments and applies a time-domain aliasing cancellation analysis transform to the windowed segments to generate blocks of transform coefficients.

4. A method for audio encoding according to claim 3 that adapts the analysis window function and the time-domain aliasing cancellation analysis transform to generate a block representing an end segment in the sequence of segments for a respective encoded information frame that permits an application of a complementary synthesis transform and synthesis window function to recover audio information with substantially no time-domain aliasing in the overlap interval of the end segment in the sequence.

5. A method for audio encoding according to claim 4 wherein the block encoding process constrains the segment lengths to be an integer power of two.

6. A method for audio encoding according to claim 4 wherein the block encoding process adapts the segment lengths between a maximum segment length and a minimum segment length and, for a respective encoded information frame, applies either:

a long-long sequence of analysis window functions to a sequence of segments having lengths equal to the maximum segment length;

a short-short sequence of analysis window functions to a sequence of segments having effective lengths equal to the minimum segment length;

a bridge-long sequence of analysis window functions to a sequence of segments having lengths that shift from the minimum segment length to the maximum segment length, wherein the bridge-long sequence comprises a first bridge sequence of window functions followed by a window function for a segment having a length equal to the maximum segment length;

a long-bridge sequence of analysis window functions to a sequence of segments having lengths that shift from the maximum segment length to the minimum segment length, wherein the long-bridge sequence comprises a window function for a segment having a length equal to the maximum segment length followed by a second bridge sequence of window functions; or a bridge-bridge sequence of analysis window functions to a sequence of segments having varying lengths, wherein the bridge-bridge sequence comprises the first bridge sequence followed by the second bridge sequence.

7. A method for audio encoding according to claim 6 wherein all segments in the short-short sequence have identical lengths.

8. A method for audio encoding according to claim 6 wherein all analysis window functions in the short-short sequence have non-zero portions that are identical in shape and length.

9. A method for audio encoding according to claim 3 wherein the block encoding process constrains the segment lengths to be an integer power of two.

10. A method for audio encoding according to claim 3 wherein the block encoding process adapts the segment lengths between a maximum segment length and a minimum segment length and, for a respective encoded information frame, applies either:

a long-long sequence of analysis window functions to a sequence of segments having lengths equal to the maximum segment length;

a short-short sequence of analysis window functions to a sequence of segments having effective lengths equal to the minimum segment length;

a bridge-long sequence of analysis window functions to a sequence of segments having lengths that shift from the minimum segment length to the maximum segment length, wherein the bridge-long sequence comprises a first bridge sequence of window functions followed by a window function for a segment having a length equal to the maximum segment length;

a long-bridge sequence of analysis window functions to a sequence of segments having lengths that shift from the maximum segment length to the minimum segment length, wherein the long-bridge sequence comprises a window function for a segment having a length equal to the maximum segment length followed by a second bridge sequence of window functions; or a bridge-bridge sequence of analysis window functions to a sequence of segments having varying lengths, wherein the bridge-bridge sequence comprises the first bridge sequence followed by the second bridge sequence.

11. A method for audio encoding according to claim 10 wherein all segments in the short-short sequence have identical lengths.

12. A method for audio encoding according to claim 10 wherein all analysis window functions in the short-short sequence have non-zero portions that are identical in shape and length.

13. A method for audio encoding according to claim 1 that comprises converting the audio information from an input audio sample rate to an internal audio sample rate prior to applying the block encoding process, wherein the reference signal conveys a video information frame rate and the internal audio sample rate is equal to an integer multiple of the video information frame rate.

14. A method for audio decoding that comprises steps performing the acts of:

receiving a reference signal conveying alignment of video information frames in a sequence of video information frames in which adjacent frames are separated by a frame interval;

receiving encoded information frames that are aligned with the reference signal and each comprise control information and a plurality of blocks of encoded audio information;

generating a control signal in response to the control information, wherein the control signal conveys segment lengths for segments of audio information in a sequence of overlapping segments, a respective segment having a respective overlap interval with an adjacent segment and the sequence having a length equal to the frame interval plus a frame overlap interval;

applying an adaptive block decoding process to the plurality of blocks of encoded audio information in a respective encoded information frame, wherein the block decoding process adapts in response to the control signal to generate the sequence of overlapping segments of audio information.

15. A method for audio decoding according to claim 14 wherein the block decoding process applies a bank of bandpass synthesis filters or a synthesis transform to the plurality of blocks of encoded information to generate the overlapping segments of audio information.

16. A method for audio decoding according to claim 14 wherein the block decoding process applies a time-domain aliasing cancellation synthesis transform to the plurality of blocks of encoded information and applies respective synthesis windows function to the results of the synthesis transform to generate the overlapping segments of audio information.

17. A method for audio decoding according to claim 16 that adapts the time-domain aliasing cancellation synthesis transform and applies a synthesis window function to the results of the transform to recover an end segment in the sequence for the respective encoded information frame with substantially no time-domain aliasing in the overlap interval of the end segment in the sequence.

18. A method for audio decoding according to claim 17 wherein the block decoding process is constrained to generate segments having lengths that are an integer power of two.

19. A method for audio decoding according to claim 17 wherein the block decoding process decodes blocks representing segments of audio information representing segments of audio information having different lengths between a maximum segment length and a minimum segment length and, for a respective encoded information frame, applies either:

a long-long sequence of synthesis window functions to a sequence of segments having lengths equal to the maximum segment length;

a short-short sequence of synthesis window functions to a sequence of segments having effective lengths equal to the minimum segment length;

a bridge-long sequence of synthesis window functions to a sequence of segments having lengths that shift from the minimum segment length to the maximum segment length, wherein the bridge-long sequence comprises a first bridge sequence of window functions followed by a window function for a segment having a length equal to the maximum segment length;

a long-bridge sequence of synthesis window functions to a sequence of segments having lengths that shift from the maximum segment length to the minimum segment length, wherein the long-bridge sequence comprises a window function for a segment having a length equal to the maximum segment length followed by a second bridge sequence of window functions; or a bridge-bridge sequence of synthesis window functions to a sequence of segments having varying lengths, wherein the bridge-bridge sequence comprises the first bridge sequence followed by the second bridge sequence.

20. A method for audio decoding according to claim 19 wherein all segments generated from the short-short sequence have identical lengths.

21. A method for audio decoding according to claim 19 wherein all synthesis window functions in the short-short sequence have non-zero portions that are identical in shape and length.

22. A method for audio decoding according to claim 16 wherein the block decoding process is constrained to generate segments having lengths that are an integer power of two.

23. A method for audio decoding according to claim 16 wherein the block decoding process decodes blocks representing segments of audio information representing segments of audio information having different lengths between a maximum segment length and a minimum segment length and, for a respective encoded information frame, applies either:

a long-long sequence of synthesis window functions to a sequence of segments having lengths equal to the maximum segment length;

a short-short sequence of synthesis window functions to a sequence of segments having effective lengths equal to the minimum segment length;

a bridge-long sequence of synthesis window functions to a sequence of segments having lengths that shift from the minimum segment length to the maximum segment length, wherein the bridge-long sequence comprises a first bridge sequence of window functions followed by a window function for a segment having a length equal to the maximum segment length;

a long-bridge sequence of synthesis window functions to a sequence of segments having lengths that shift from the maximum segment length to the minimum segment length, wherein the long-bridge sequence comprises a window function for a segment having a length equal to the maximum segment length followed by a second bridge sequence of window functions; or a bridge-bridge sequence of synthesis window functions to a sequence of segments having varying lengths, wherein the bridge-bridge sequence comprises the first bridge sequence followed by the second bridge sequence.

24. A method for audio decoding according to claim 23 wherein all segments generated from the short-short sequence have identical lengths.

25. A method for audio decoding according to claim 23 wherein all synthesis window functions in the short-short sequence have non-zero portions that are identical in shape and length.

26. A method for audio decoding according to claim 14 that analyzes control information obtained from two encoded information frames to detect a discontinuity and, in response, adapts frequency response characteristics of the block decoding process in recovering first or last segments of audio information in a respective sequence of segments for either of the two encoded information frames.

27. An information storage medium carrying:

video information arranged in video frames; and encoded audio information arranged in encoded information frames, wherein a respective encoded information frame corresponds to a respective video frame and includes control information conveying segment lengths for segments of audio information in a sequence of overlapping segments, a respective segment having a respective overlap interval with an adjacent segment and the sequence having a length equal to the frame interval plus a frame overlap interval, and blocks of encoded audio information, a respective block having a respective length and respective content that, when processed by an adaptive block-decoding process, results in a respective segment of audio information in the sequence of overlapping segments.

28. An information storage medium according to claim 27 wherein the respective block of encoded information has respective content that results in the respective segment of audio information when processed by an adaptive decoding process that includes applying a time-domain aliasing cancellation synthesis transform and applying a synthesis window function.

29. An information storage medium according to claim 28 where the adaptive block decoding process adapts the time-domain aliasing cancellation synthesis transform and adapts the synthesis window function to generate the sequence of overlapping segments of audio information that independently has substantially no time-domain aliasing.

30. An information storage medium according to claim 29 wherein all blocks of encoded audio information represent segments of audio information that have respective lengths that are integer powers of two.

31. An information storage medium according to claim 28 wherein all blocks of encoded audio information represent segments of audio information that have respective lengths that are integer powers of two.

32. An information storage medium according to claim 27 wherein the control information includes an indication of order of the respective encoded information frame within a sequence of encoded information frames.

* * * * *